US010582743B2

(12) United States Patent
Ronsen

(10) Patent No.: US 10,582,743 B2
(45) Date of Patent: Mar. 10, 2020

(54) SYSTEM AND METHOD FOR ACTIVATED INTERLOCKING FASTENERS AND SEALS

(71) Applicant: David Ronsen, Las Vegas, NV (US)

(72) Inventor: David Ronsen, Las Vegas, NV (US)

(73) Assignee: DELPHINI, LLC, Carlsbad, CA (US)

( * ) Notice: Subject to any disclaimer, the term of this patent is extended or adjusted under 35 U.S.C. 154(b) by 172 days.

(21) Appl. No.: 15/076,030

(22) Filed: Mar. 21, 2016

(65) Prior Publication Data

US 2017/0265603 A1 Sep. 21, 2017

(51) Int. Cl.
*A44B 18/00* (2006.01)

(52) U.S. Cl.
CPC ..... *A44B 18/0073* (2013.01); *A44B 18/0007* (2013.01); *A44B 18/0011* (2013.01); *A44B 18/0015* (2013.01); *A44B 18/0019* (2013.01); *A44B 18/0096* (2013.01)

(58) Field of Classification Search
CPC ..... A44B 18/0073; A44B 18/0007; A44B 18/0011; A44B 18/0015; A44B 18/0019; A44B 18/0096
See application file for complete search history.

(56) References Cited

U.S. PATENT DOCUMENTS 4,322,875 A * 4/1982 Brown ..... A44B 18/0019 24/447
4,984,339 A 1/1991 Provost et al.
5,250,167 A 10/1993 Adolf et al.
5,339,499 A 8/1994 Kennedy et al.
5,389,222 A 2/1995 Shahinpoor
5,457,855 A 10/1995 Kenney et al.
5,473,800 A * 12/1995 Hatomoto ..... A44B 18/0019 24/442
5,691,021 A * 11/1997 Kobe ..... A44B 18/0019 24/442
5,735,607 A 4/1998 Shahinpoor et al.
(Continued)

FOREIGN PATENT DOCUMENTS

EP 2241512 A2 10/2010
EP 1781853 B1 2/2011
(Continued)

OTHER PUBLICATIONS

M. Shahinpoor et al., "Ionic Polymeric Conductor Composite Artificial Muscles," ERI/AMRI Press, Albuquerque, N. Mex., 2nd Edition, (2005).

(Continued)

*Primary Examiner* — Jason W San

(57) ABSTRACT

An active interlocking fastener system is adapted to control an interlock in response to an external stimulus. The interlocking fastener system includes a first element including a plurality of first interlocking fasteners. The interlocking fastener system also includes a second element including a plurality of second interlocking fasteners configured to couple to the first plurality of interlocking fasteners. The plurality of first interlocking fasteners or the plurality of second interlocking fasteners includes a reactive material configured to vary a mechanical engagement between the plurality of first interlocking fasteners and the plurality of second interlocking fasteners as a function of the external stimulus.

13 Claims, 8 Drawing Sheets

(56) References Cited

U.S. PATENT DOCUMENTS

| | | | | |
|---|---|---|---|---|
| 5,980,230 | A | 11/1999 | Dowd et al. | |
| 5,981,027 | A | 11/1999 | Parellada | |
| 5,996,189 | A | 12/1999 | Wang | |
| 6,003,582 | A | 12/1999 | Blohowiak et al. | |
| 6,109,852 | A | 8/2000 | Shahinpoor et al. | |
| 6,117,060 | A | 9/2000 | Bodolay | |
| 6,192,171 | B1 | 2/2001 | Goodman et al. | |
| 6,224,807 | B1 | 5/2001 | Clune | |
| 6,405,532 | B1 | 6/2002 | Shahinpoor et al. | |
| 6,433,543 | B1 | 8/2002 | Shahinpoor et al. | |
| 6,449,989 | B2 | 9/2002 | Ternon | |
| 6,464,655 | B1 | 10/2002 | Shahinpoor | |
| 6,475,639 | B2 | 11/2002 | Shahinpoor et al. | |
| 6,511,508 | B1 | 1/2003 | Shahinpoor et al. | |
| 6,512,739 | B1 | 1/2003 | Heidari et al. | |
| 6,546,602 | B1 * | 4/2003 | Eipper | A44B 18/0003 24/304 |
| 6,589,198 | B1 | 7/2003 | Soltanpour et al. | |
| 6,598,274 | B1 * | 7/2003 | Marmaropoulos | A44B 18/0003 24/442 |
| 6,645,600 | B2 | 11/2003 | Martin et al. | |
| 6,678,434 | B1 | 1/2004 | Goodman et al. | |
| 6,682,500 | B2 | 1/2004 | Soltanpour et al. | |
| 6,726,612 | B1 | 4/2004 | Bodolay | |
| 6,829,499 | B1 | 12/2004 | Shahinpoor et al. | |
| 6,837,620 | B2 | 1/2005 | Shahinpoor | |
| D516,952 | S | 3/2006 | Kingsford et al. | |
| 7,060,094 | B2 | 6/2006 | Shahinpoor et al. | |
| 7,090,696 | B2 | 8/2006 | Shahinpoor et al. | |
| 7,220,501 | B2 | 5/2007 | Merzougui et al. | |
| D578,772 | S | 10/2008 | Provost et al. | |
| 7,601,284 | B2 | 10/2009 | Clune | |
| 9,072,343 | B1 * | 7/2015 | Ogilvie | A44B 18/0023 |
| 9,775,411 | B2 * | 10/2017 | Dyllong | A44B 18/0053 |
| 2004/0033336 | A1 * | 2/2004 | Schulte | A44B 18/0049 428/100 |
| 2004/0074064 | A1 * | 4/2004 | Powell | A44B 18/0003 24/442 |
| 2004/0117955 | A1 * | 6/2004 | Barvosa-Carter | A44B 18/0003 24/442 |
| 2004/0148744 | A1 | 8/2004 | Offa-Jones | |
| 2004/0167003 | A1 | 8/2004 | Bodolay | |
| 2005/0000065 | A1 * | 1/2005 | Browne | A44B 18/0096 24/442 |
| 2005/0118388 | A1 | 6/2005 | Kingsford | |
| 2005/0123726 | A1 * | 6/2005 | Broering | A44B 18/0011 428/172 |
| 2006/0078370 | A1 | 4/2006 | Autterson | |
| 2007/0196430 | A1 | 8/2007 | Shahinpoor et al. | |
| 2011/0265292 | A1 * | 11/2011 | Kirby | A44B 18/0053 24/451 |
| 2011/0265293 | A1 | 11/2011 | Idrizovic et al. | |
| 2012/0010588 | A1 | 1/2012 | Morishita | |
| 2012/0231206 | A1 | 9/2012 | Thompson, Jr. et al. | |
| 2013/0246013 | A1 | 9/2013 | Looney et al. | |
| 2014/0103567 | A1 * | 4/2014 | Collins | B29C 43/222 264/167 |
| 2014/0283342 | A1 * | 9/2014 | Adams | A44B 18/0007 24/442 |
| 2014/0298627 | A1 | 10/2014 | Shields | |
| 2017/0305608 | A1 * | 10/2017 | Freulon | B65D 33/24 |
| 2017/0325552 | A1 * | 11/2017 | Bronson | A44B 18/0019 |
| 2018/0008010 | A1 * | 1/2018 | Verstraete | A44B 18/003 |

FOREIGN PATENT DOCUMENTS

| | | | |
|---|---|---|---|
| EP | 2361761 | A1 | 8/2011 |
| WO | 03/074371 | A2 | 9/2003 |
| WO | 2009/137588 | A1 | 11/2009 |
| WO | 2014/149825 | A1 | 9/2014 |

OTHER PUBLICATIONS

M. Shahinpoor, "Ionic Polymer Conductor Composite Materials as Distributed Nanosensors, Nanoactuators and Artificial Muscles—A Review", Proceedings of the Second World Congress on Biomimetics and Artificial Muscle (Biomimetics and Nano-Bio 2004), Dec. 5-8, 2004, Albuquerque Convention Center, Albuquerque, N. Mex., USA, (2004).

M. Shahinpoor, "Ionic Polymer Conductor Composites As Distributed Nanosensors, Nanoactuators and Artificial Muscles—A Review of Recent Findings", Proceeding of the International Conference on Advanced Materials and Nanotechnology, AMN-1, The MacDiarmid Institute for Advanced Materials and Nanotechnology, Feb. 9-11, 2003, Wellington, New Zealand, pp. 14-22, (2003).

M. Shahinpoor, "Artificial Muscles", Chapter in Encyclopedia of Biomaterials and Biomedical Engineering, edited by G. Wnek and G. Bowlin, Marcel Dekker Publishers, New York, N.Y., (2004).

M. Shahinpoor et al., Ionic Polymer-Conductor Composites (IPCC) as Biomimetic Sensors, Actuators and Artificial Muscles, Selected Topics in Structronics and Mechatronic Systems, Editors: A. Belyaev and A. Guran, pp. 417-436, World Scientific Publishers, London, (2003). (Abstract only).

M. Shahinpoor, "Ionic Polymer-Conductor Composites As Biomimetic Sensors, Robotic Actuators and Artificial Muscles—A Review", Electrochimica Acta, vol. 48, No. 14-16, pp. 2343-2353, (2003).

K. J. Kim et al., "Application of Polyelectrolytes in Ionic Polymeric Sensors, Actuators, and Artificial Muscles", Review Chapter in Handbook of Polyelectrolytes and their Applications, edited by S. K. Tripathy, J. Kumar and H. S. Nalwa, vol. 3; Applications of Polyelectrolytes and Theoretical Models, American Scientific Publishers, Stevenson Ranch, Calif., USA (2002).

K. J. Kim et al., "A Novel Method of Manufacturing Three-Dimensional Ionic Polymer-Metal Composites (IPMC's) Biomimetic Sensors, Actuators and Artificial Muscle", Polymer, vol. 43/3, pp. 797-802 (2002).

M. Shahinpoor et al., "Novel Ionic Polymer-Metal Composites Equipped with Physically-Loaded Particulate Electrode As Biomimetic Sensors, Actuators and Artificial Muscles", Actuators and Sensors A, Physical, 96(2/3) A, 3163, pp. 125-132, (2002).

M. Shahinpoor et al., "Ionic Polymer-Metal Composites (IPMC) As Biomimetic Sensors, Actuators & Artificial Muscles —A Review", Journal of Smart Materials, vol. 7, Feb. 1998, 28 pages.

M. Shahinpoor, "Active Polyelectrolyte Gels As Electrically-Controllable Artificial Muscles and Intelligent Network Structure", Book Chapter in Structronic Systems, Part II, edited by: H. S. Tzou, A. Guran, U. Gabbert, J. Tani and E. Breitbach, World Scientific Publishers, London, pp. 31-85, (1998). (Abstract only).

"Design and Modeling of a Novel Fibrous SMA Actuator," Proc. SPIE Smart Materials and Structures Conference, vol. 2190, pp. 730-738 (1994).

"A Phenomenological Description of Thermodynamical Behavior of Shape Memory Alloys," Transactions of the ASME, J. Appl. Mech., vol. 112, pp. 158-163 (1990).

* cited by examiner

SYSTEM AND METHOD FOR ACTIVATED INTERLOCKING FASTENERS AND SEALS

TECHNICAL FIELD

This application relates to interlocking fasteners, and more specifically to system and method for an activated interlocking fastener.

BACKGROUND

Interlocking fasteners, such as the hook and loop fastener commonly referred under the trademark name VELCRO, are well known. The interlocking fasteners involve a mechanical engagement of a hook with some form of loop, a mechanical engagement of two hooks, or a mechanical engagement of a hook and an opening, or a male-female connector such as a bulb and socket.

SUMMARY

This disclosure provides a method and system for controlling an interlocking fastener.

In certain embodiments, an interlocking fastener system is provided. The interlocking fastener system includes a first element including a plurality of first interlocking fasteners. The interlocking fastener system also includes a second element including a plurality of second interlocking fasteners configured to couple to the first plurality of interlocking fasteners. The plurality of first interlocking fasteners or the plurality of second interlocking fasteners includes a reactive material configured to vary a mechanical engagement between the plurality of first interlocking fasteners and the plurality of second interlocking fasteners as a function of an external stimulus.

In certain embodiments, an interlocking apparatus is provided. The interlocking apparatus includes a plurality of first interlocking fasteners configured to couple to a second plurality of interlocking fasteners. The interlocking apparatus also includes an activation means. The plurality of first interlocking fasteners comprises a reactive material configured to, as a function of an external stimulus, vary a shape or position of the plurality of first interlocking fasteners to alter a mechanical engagement between the plurality of first interlocking fasteners and the plurality of second interlocking fasteners.

In certain embodiments, a method is provided. The method includes coupling a plurality of first interlocking fasteners on a first element to a plurality of second interlocking fasteners on a second element. The plurality of first interlocking fasteners or the plurality of second interlocking fasteners includes a reactive material. The method also includes applying an external stimulus to the reactive material to control a mechanical engagement between the plurality of first interlocking fasteners and the plurality of second interlocking fasteners.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
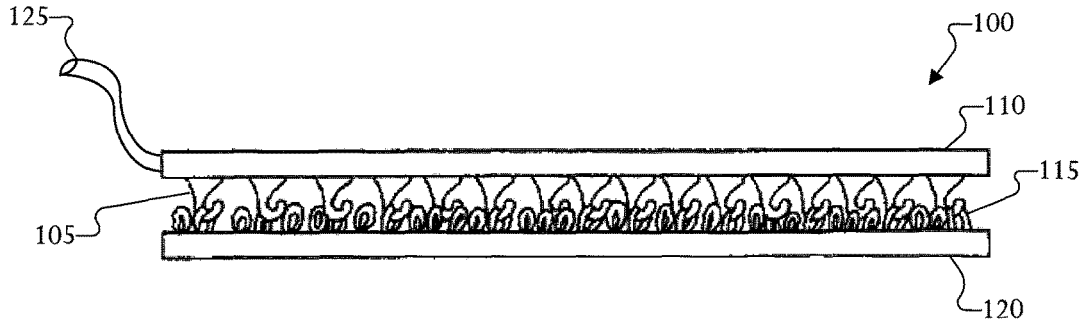
FIG. 1 illustrates a hook and loop active interlocking fastener according to the present disclosure.

FIGS. 1 through 18, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged fastening system.

Interlocking fasteners include various designs and configurations, such as the hook and loop fastener commonly referred under the trademark name VELCRO, interlocking islands including, which include QWIKGRIP multi-directional self-engaging fasteners (SEFs), and edge fasteners including V-LOK and D-LOK. Examples of various interlocking fasteners include those found in: European Patent Specification EP 1781853 entitled NONWOVEN LOOP SHEET AND HOOK AND LOOP FASTENING TAPE; U.S. Pat. No. 4,984,339 entitled HOOK FOR HOOK AND LOOP FASTENERS; U.S. Pat. No. 5,339,499 entitled HOOK DESIGN FOR HOOK AND LOOP FASTENER; U.S. Pat. No. 5,457,855 entitled WOVEN SELF-ENGAGING FASTENER; U.S. Pat. No. 5,980,230 entitled FORMING FASTENER PRODUCTS; U.S. Pat. No. 5,981,027 entitled FASTENING MEMBER WITH LOOPS AND PROCESS AND MACHINE FOR PRODUCING IT; U.S. Pat. No. 5,996,189 entitled WOVEN FASTENER PRODUCT; U.S. Pat. No. 6,224,807 entitled METHODS OF MOLDING FASTENERS AND OF FORMING FASTENER MOLDS; U.S. Pat. No. 6,449,989 entitled HOOK AND LOOP FASTENING STRUCTURE; U.S. Pat. No. 6,645,600 entitled HOOK AND LOOP FASTENER HAVING AN INCREASED COEFFICIENT OF FRICTION; U.S. Pat. No. 7,601,284 entitled MOLDING FASTENER ELEMENTS ON FOLDED SUBSTRATE; United States Publication Number (USPUB) 2005/0118388 entitled SKIN ATTACHMENT MEMBER; USPUB 2011/0265293 entitled MALE TOUCH FASTENER ELEMENT; USPUB 2011/0265292 entitled QUIET RELEASE SHAPE MEMORY POLYMER FASTENERS; USPUB 2012/0010588 entitled FEMALE PART OF HOOK AND LOOP FASTENER; USPUB 2012/0231206 entitled LOOP MATERIAL FOR HOOK AND LOOP FASTENER; USPUB 2013/0246013 entitled COMPUTER BASED MODELS OF HOOK AND LOOP FASTENING SYSTEMS; USPUB 2014/0298627 entitled HOOK-AND-LOOP FASTENER; USPUB 2006/0078370 entitled RECLOSABLE FASTENER RISER/SPACER, AND METHODS OF CONSTRUCTING AND UTILIZING SAME; U.S. Design Pat. D516,952 entitled TOUCH FASTENER ELEMENT; U.S. D Pat. D578,772 entitled BRISTLE ARRAY; European Patent Application (EP) EP2241512 entitled RECLOSABLE FASTENERS OR ZIPPERS FOR USE WITH POLYMERIC BAGS; Patent Cooperation Treaty (PCT) application PCT/US2014/021084 entitled ADHESIVE RECLOSABLE FASTENERS WITH VISUAL INDICATORS; USPUB 2004/0167003 entitled CONTINUOUS SUPPLY OF PREFORMED RECLOSABLE FASTENERS; U.S. Pat. No. 6,117,060 entitled CONTINUOUS SUPPLY OF PREFORMED RECLOSABLE FASTENERS; PCT/US2003/006050 entitled RECLOSABLE FASTENERS OR ZIPPERS FOR USE WITH POLYMERIC BAGS; USPUB 2004/0148744 entitled RECLOSABLE FASTENERS FOR PLASTICS BAGS AND THE LIKE; PCT/US2009/042998 entitled COHESIVE RECLOSABLE FASTENERS FOR FLEXIBLE PACKAGES; EP2361761 entitled RECLOSABLE FASTENERS, PACKAGES HAVING RECLOSABLE FASTENERS, AND METHODS FOR CREATING RECLOSABLE FASTENERS; U.S. Pat. No. 6,726,612 entitled CONTINUOUS SUPPLY OF PREFORMED RECLOSABLE FASTENERS; and U.S. Pat. No. 6,003,582 entitled APPARATUS FOR APPLYING RECLOSABLE FASTENERS TO A WEB OF FILM. The contents of each of these documents are hereby incorporated by reference in their entirety.

The interlocking fasteners, such as the ones disclosed in the aforementioned documents require mild pressure to cause a mechanical engagement between two interlocking elements, such as between a hook and loop, between two self-engaging protrusions, between a hook and an opening, and so forth. In order to disconnect the interlocking fasteners, a separation force must be applied to the interlocking fasteners to sever the mechanical engagement between the two interlocking elements. For this reason, many interlocking fasteners are designed to bend, or deform, in response to a certain force being applied to the interlocking features, such as shown in U.S. Pat. No. 4,984,339. For example, in response to a human gently pulling on one or both sides of the interlocking fastener, the hook may deform. Opposing loads applied perpendicularly to respective elements of the interlocking fastener are referenced as tension forces. Herein, a tension strength of an interlocking fastener refers to a tension force required to disengage elements from each other, namely, to disengage the mechanical engagement between two elements. Accordingly, the tension strength of the interlocking fastener can be directly proportional to the hook's resistance to deformation.

Embodiments of the present disclosure provide active interlocking fasteners that are configured to deform, or otherwise alter in shape or orientation, in response to a stimulus applied to the interlocking fastener. In certain embodiments, the active interlocking fastener is configured to deform in response to removal of a stimulus. Certain embodiments of the present disclosure provide an active interlocking fastener having a tension strength in excess of fifty pounds per square inch. Certain embodiments of the present disclosure provide an active interlocking fastener that, as a function of a stimulus, are configured to disengage with minimal force, such as less than one pound per square inch, or no force.

Certain embodiments of the active interlocking fasteners are formed from a reactive material that is adapted to respond or deform to an external stimulus. Examples of the reactive material used in one or more of the disclosed embodiments to form the active interlocking fasteners include electroactive polymers (EAP), Stimuli-responsive gels, and the like.

EAPs are polymers that exhibit a change in size or shape when stimulated by an electric field and are also references as artificial muscles. Examples of artificial muscles can be found in: USPUB 2007/0196430 entitled SYNTHETIC MUSCLE-BASED MULTI-POWERED ACTIVE CONTACT LENS; U.S. Pat. No. 7,060,09 entitled ACCOMMODATING ZONULAR MINI-BRIDGE IMPLANTS; U.S. Pat. No. 6,837,620 entitled SHAPE MEMORY ALLOY TEMPERATURE SENSOR-2: CIP; U.S. Pat. No. 6,829,499 entitled BIOELECTRIC SENSOR AND SWITCH SYSTEM FOR MEDICAL IMAGING; U.S. Pat. No. 6,682,500 entitled SYNTHETIC MUSCLE-BASED DIAPHRAGM PUMP APPARATUSES; U.S. Pat. No. 6,678,434 entitled DISK DRIVE OPTICAL SWITCH; U.S. Pat. No. 6,433,543 entitled SMART FIBER OPTICMAGNETOMETER; U.S. Pat. No. 6,464,655 entitled ELECTRICALLY-CONTROLLABLE MULTI-FINGERED RESILIENT HEARTCOMPRESSION DEVICES; U.S. Pat. No. 6,475,639 entitled IONIC POLYMER SENSORS AND ACTUATORS; U.S. Pat. No. 6,511,508 entitled SURGICAL CORRECTION OF HUMAN EYE REFRACTIVE ERRORS BY ACTIVE COMPOSITE ARTIFICIAL MUSCLE IMPLANTS; U.S.

Pat. No. 6,589,198 entitled IMPLANTABLE MICRO-PUMP ASSEMBLY; U.S. Pat. No. 6,512,739 entitled SMART TEMPERATURE SENSOR; U.S. Pat. No. 6,682,500 entitled SYNTHETIC MUSCLE-BASED DIAPHRAGM PUMP APPARATUSES; U.S. Pat. No. 6,829,499 entitled BIOELECTRIC SENSOR AND SWITCH FOR MEDICAL IMAGING; U.S. Pat. No. 6,837,620 entitled SHAPE MEMORY ALLOY TEMPERATURE SENSOR-2-CIP; U.S. Pat. No. 5,250,167 entitled ELECTRICALLY CONTROLLED POLYMERIC GEL ACTUATORS; U.S. Pat. No. 5,389,222 entitled SPRING-LOADED IONIC POLYMERIC GEL ACTUATOR; U.S. Pat. No. 6,109,852 entitled SOFT ACTUATORS AND ARTIFICIAL MUSCLES; U.S. Pat. No. 6,192,171 entitled DYNAMIC FIBER OPTIC SWITCH WITH ARTIFICIAL MUSCLES; U.S. Pat. No. 6,475,639 entitled IONIC POLYMER SENSORS AND ACTUATORS; and U.S. Pat. No. 6,405,532 entitled METAL HYDRIDE ARTIFICIAL MUSCLES. The contents of each of these documents are hereby incorporated by reference in their entirety.

In certain embodiments, the reactive material is formed from polyacrylonitrile artificial muscles, such as ionic polymer artificial muscles. Ionic polymeric artificial muscles and, in particular, contractile artificial muscles are described in the following references, each of which is incorporated by reference in its entirety for all purposes: U.S. Pat. Nos. 6,109,852 and 6,475,639; See also, M. Shahinpoor, K. J. Kim and Mehran Mojarrad, "Ionic Polymeric Conductor Composite Artificial Muscles," *ERI/AMRI Press*, Albuquerque, N. Mex., 2$^{nd}$ Edition, (2005); M. Shahinpoor, "Ionic Polymer Conductor Composite Materials as Distributed Nanosensors, Nanoactuators and Artificial Muscles—A Review", Proceedings of the Second World Congress On Biomimetics and Artificial Muscle (Biomimetics and Nano-Bio 2004), Dec. 5-8, 2004, Albuquerque Convention Center, Albuquerque, N. Mex., USA, (2004); M. Shahinpoor, "Ionic Polymer Conductor Composites As Distributed Nano sensors, Nanoactuators and Artificial Muscles—A Review of Recent Findings", *Proceeding of The International Conference on Advanced Materials and Nanotechnology, AMN*-1, *The MacDiarmid Institute for Advanced Materials and Nanotechnology,* 9-11 Feb. 2003, Wellington, New Zealand, pp. 14-22, (2003); M. Shahinpoor, "Artificial Muscles", *Chapter in Encyclopedia of Biomaterials and Biomedical Engineering*, edited by G. Wnek and G. Bowlin, Marcel Dekker Publishers, New York, N.Y., (2004); M. Shahinpoor and A. Guran, "Ionic Polymer-Conductor Composites (IPCC) as Biomimetic Sensors, Actuators and Artificial Muscles, *SELECTED TOPICS IN STRUCTRONICS AND MECHATRONIC SYSTEMS*, Editors: A. Belyaev and A. Guran, pp. 417-436, World Scientific Publishers, London, (2003); M. Shahinpoor, "Ionic Polymer-Conductor Composites As Biomimetic Sensors, Robotic Actuators and Artificial Muscles—A Review", *Electrochimica Acta*, Vol. 48, No. 14-16, pp. 2343-2353, (2003); K. J. Kim and M. Shahinpoor, "Application of Polyelectrolytes in Ionic Polymeric Sensors, Actuators, and Artificial Muscles", Review Chapter in *Handbook of Polyelectrolytes and their Applications*, edited by S. K. Tripathy, J. Kumar and H. S. Nalwa, vol. 3; Applications of Polyelectrolytes and Theoretical Models, American Scientific Publishers, Stevenson Ranch, Calif., USA (2002); K. J. Kim and M. Shahinpoor, "A Novel Method of Manufacturing Three-Dimensional Ionic Polymer-Metal Composites (IPMC's) Biomimetic Sensors, Actuators and Artificial Muscle", *Polymer*, Vol. 43/3, pp. 797-802 (2002); M. Shahinpoor and K. J. Kim, "Novel Ionic Polymer-Metal Composites Equipped with Physically-Loaded Particulate Electrode As Biomimetic Sensors, Actuators and Artificial Muscles", *Actuators and Sensors A, Physical,* 96(2/3) A, 3163, pp. 125-132, (2002); M. Shahinpoor, Y. Bar-Cohen, J. Simpson and J. Smith, "Ionic Polymer-Metal Composites (IPMC's) As Biomimetic Sensors, Actuators and Artificial Muscles—A Review", *Smart Materials & Structures Int. Journal*, vol. 7, pp. R15-R30, (1998); and M. Shahinpoor, M., "Active Polyelectrolyte Gels As Electrically-Controllable Artificial Muscles and Intelligent Network Structure", Book *Chapter in Structronic Systems, Part II*, edited by: H. S. Tzou, A. Guran, U. Gabbert, J. Tani and E. Breitbach, World Scientific Publishers, London, pp. 31-85, (1998). The contents of each of these documents are hereby incorporated by reference in their entirety. The polyacrylonitrile artificial muscles can be configured to react to a chemical or fluid applied to the polyacrylonitrile artificial muscles. In certain embodiments, the reactive material is a Dry Electro-Active Polymeric Synthetic Muscle.

In certain embodiments, the reactive material is formed from shape memory alloys (SMA). An SMA can be trained to have a certain shape in its Austenitic state or at temperatures above the SMA's Austenitic finish temperature $A_f$. The SMA moves in a certain fashion to a second shape, its Martensitic state, which is a softer state for the material, when the temperature drops below the Austenitic finish temperature $A_f$ and eventually reaches below the Martensite start temperature $M_s$. The SMA will not return to the Martensite shape without additional external force even if the temperature subsequently falls below the Austenitic temperature $A_f$. SMAs are used in a variety of applications, such as those described in "Design and Modeling of a Novel Fibrous SMA Actuator," Proc. SPIE Smart Materials and Structures Conference, vol. 2190, pp. 730-738 (1994), and "A Phenomenological Description of Thermodynamical Behavior of Shape Memory Alloys," Transactions of the ASME, J. Appl. Mech., vol. 112, pp. 158-163 (1990). SMAs have been suggested for use in persistent temperature indicators. See U.S. Pat. Nos. 5,735,607 and 7,220,501. The contents of each of the documents are incorporated herein by reference. The SMAs can be formed from materials, such as Nitinol (NiTi) or Magnetic Shape-Memory (MSM), such as NiMnGa or Ni2MnGa, and an actuator such as in the form of wires or ribbons with attachable ends to make an endless band encased or embedded inside a silicone rubber sheath or cladding. An example of such SMA can be found in U.S. Pat. No. 7,090,696, the contents of which are hereby incorporated by reference in its entirety.

Stimuli-responsive gels, such as hydrogels and polymer gels, when the swelling agent is an aqueous solution, are a special kind of swellable polymer networks with volume phase transition behavior. These materials change reversibly their volume, optical, mechanical and other properties by very small alterations of certain physical stimuli, such as electric field, light, temperature, or chemical stimuli, such as changes in chemical concentration. The volume change of these materials occurs by swelling or shrinking and is diffusion-based.

In certain embodiments, the reactive material is inflatable. For example, the reactive material can be formed from material comprising at least one of a plastic foil, toughened polymer based fabrics, a polymer material, a carbon fiber material, a fiber glass epoxy material. The reactive material can be expanded by injection of a liquid or gaseous substance and contracted by expulsion of the gaseous substance. In certain embodiments, the reactive material is comprised of artificial cilia, an electrorheoligical liquid or a phase changing chemical. In certain embodiments, the reactive material is responsive to electrostatic repulsion. In certain embodiments, the reactive material includes one or more piezoceramic components and actuators.

FIG. 1 illustrates a hook and loop active interlocking fastener (AIF) according to the present disclosure. The embodiment of the hook and loop AIF 100 shown in FIG. 1 is for illustration only. Other embodiments could be used without departing from the scope of this disclosure. For example, embodiments including multi-barbed hooks and other shapes could be used without departing from the scope of the present disclosure.

In the example shown in FIG. 1, the hook and loop AIF 100 is in a closed position. In the closed position, one or more hooks 105 on an active element 110 are mechanically engaged with one or more loops 115 on a receiving element 120. The hook and loop AIF 100 includes an activation means 125 for controlling a deformation of the hooks 105 on the active element.

The hooks 105 are formed from a reactive material, such as a material formed from EAPs. In certain embodiments, the reactive material is formed from stimuli responsive gel. In certain embodiments, the reactive material is formed from another suitable material configured to react to an external stimulus, such as those disclosed herein above. In certain embodiments, the hooks 105 are configured to extend, or deform by straightening, such that the hooks 105 do not mechanically engage the loops 115.

The activation means 125 can include one or more of: an electrical signal; magnetic force; a temperature signal, such as applied heat above a certain threshold temperature or applied coolness below a threshold temperature; a fluid, such as water, saline, or another liquid; a chemical; light; or sound, such as a tone at a specific amplitude or frequency, or both. The activation means 125 delivers a stimulus to the active element 110. In certain embodiments, the activation means 125 includes a physical carrier structure, such as a tube, conductor, or other transmission conduit. In certain embodiments, the stimulus is delivered via a non-physical contact medium, such as wirelessly, optically, sonically, and so forth.

Figure 2:
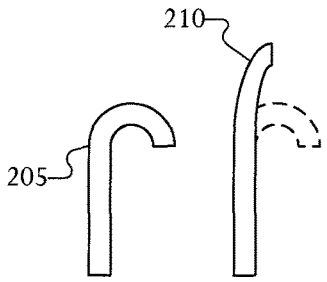
FIGS. 2 and 3 illustrate neutral and deformed states of the hook and loop active interlocking fastener according to the present disclosure.
Figure 3:
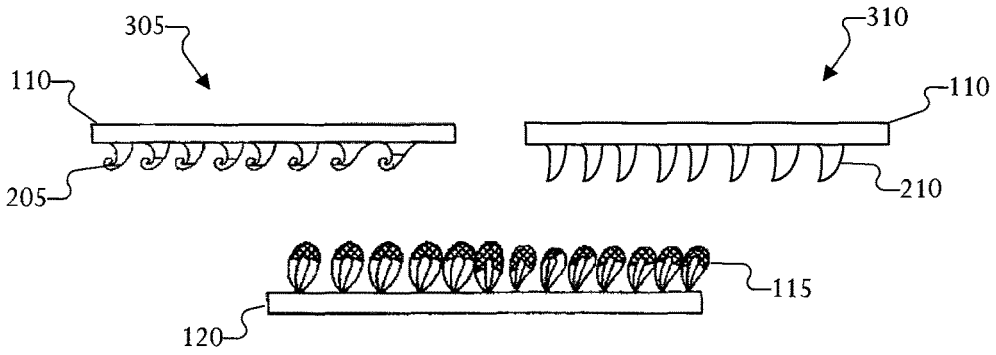

FIGS. 2 and 3 illustrate neutral and deformed states of the hook and loop AIF according to the present disclosure. FIG. 2 illustrates the hook and loop AIF in an open position according to the present disclosure. FIG. 3 illustrates states of the hooks 105 according to the present disclosure. The embodiments of the neutral and deformed states shown in FIGS. 2 and 3 are for illustration only. Other embodiments could be used without departing from the scope of the present disclosure.

In response to the external stimuli received via the activation means 125, one or more of the hooks 105 deform. For example, when in a neutral state in which no external stimulus is provided, the hooks 105 are in a curved state 205 such that the hooks can mechanically engage with the loops 115. Therefore, in the neutral state, the active element 110 is in a locking shape 305 and is able to form an interlocking connection with the receiving element 120. In the interlocking connection, the active element 110 is fastened to, or locked with, the receiving element 120, namely hooks 105 are mechanically coupled with loops 115, such that considerable separation force is required to sever the mechanical connection between the active element 110 and the receiving element 120. That is, when in an interlocking connection, the active element 110 and the receiving element 120 maintain a mechanical connection against a separation force, such as up to fifty pounds per square inch, applied to the hook and loop AIF 100. When the external stimuli is applied, such as via the activation means 125, the hooks 105 deform such that the hooks 105 no longer retain a hook-shape and enter a deformed state in which the hooks 110 become straight 210 such that the hooks 105 are unable to mechanically engage the loops 115. Therefore, in the deformed state, the active element 110 is in a non-locking shape 310 and is unable to form an interlocking connection with the receiving element 120.

In certain embodiments, the hooks 105 are straight 210 while in the neutral state and curved 205 while in the deformed state. For example, when in a neutral state in which no external stimuli is provided, the hooks 105 are straight 210 such that the hooks are unable to mechanically engage with the loops 115. Therefore, in the neutral state, the active element 110 is in the non-locking shape 310 and is unable to form an interlocking connection with the receiving element 120. When the external stimuli is applied, such as via the activation means 125, the hooks 105 deform such that the hooks 105 enter form a curve 205 and enter a deformed state such that the hooks 105 are able to mechanically engage the loops 115. Therefore, in the deformed state, the active element 110 is in the locking shape 305 and is able to form an interlocking connection with the receiving element 120

In certain embodiments, the external stimulus is a liquid or chemical applied to the reactive material. When applied the external stimuli causes the reactive material to deform. In certain embodiments, the liquid or chemical is manually removed from the reactive material to return the reactive material to its neutral state. In certain embodiments, as the liquid or chemical evaporates or changes in chemical makeup respectively, the reactive material returns to its neutral state.

Figure 4:
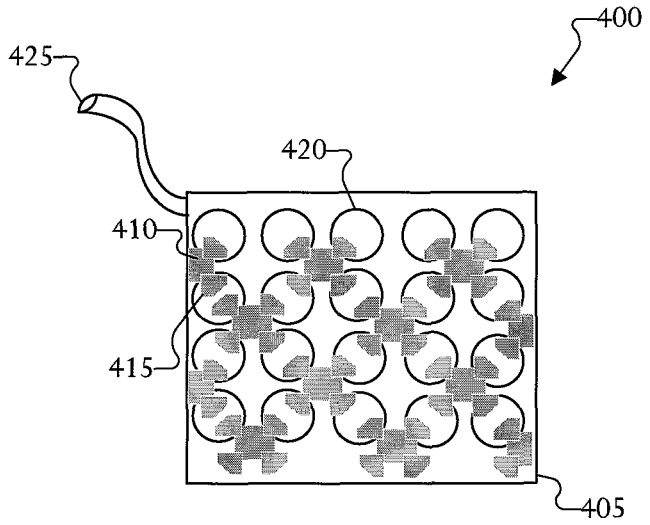
FIG. 4 illustrates an island active interlocking fastener (AIF) according to the present disclosure.

FIG. 4 illustrates an island active interlocking fastener (AIF) according to the present disclosure. The embodiment of the island AIF 400 shown in FIG. 4 is for illustration only. Other embodiments could be used without departing from the scope of this disclosure.

In the example shown in FIG. 4, the island AIF 400 includes a base 405 at one planar level coupled to plurality of islands 410 that extend to form respective locking surfaces 415 at a second planar level. A receiving element is substantially similar to an active element. For example, both the receiving element and the active element can be identical. In certain embodiments, both sides of the island AIF 400 are active elements. In the closed position, one or more islands 410 on the active element are mechanically engaged with one or more islands 410 on the receiving element. That is, at least one locking surfaces 415 on the islands 410 overlaps with at least one locking surface 410 on the islands 410 of a receiving element causing the islands 410 to mechanically interlock. In certain embodiments, the base 405 includes a plurality of openings, or via's 420 located proximate to the islands 410. The island AIF 400 includes an activation means 425 for controlling a deformation of the islands 410 on the active element.

The islands 410 are formed from a reactive material, such as a material formed from EAPs. In certain embodiments, the reactive material is formed from stimuli responsive gel. In certain embodiments, the reactive material is formed from another suitable material configured to react to an external stimuli, such as those disclosed herein above. In certain embodiments, the islands 410 are configured to rotate, extend, or deform by straightening or turning, such that the islands 410 on the active element do not mechanically engage the islands 410 on the receiving element.

The activation means 425 can include one or more of: an electrical signal; a magnetic force; a temperature signal, such as applied heat above a certain threshold temperature or applied coolness below a threshold temperature; a fluid, such as water, saline, or another liquid; a chemical; light; or sound, such as a tone at specific amplitude or frequency, or both. The activation means 425 delivers a stimulus to islands 410 on the active element. In certain embodiments, the activation means 425 includes a physical carrier structure, such as a tube, conductor, or other transmission conduit. In certain embodiments, the stimulus is delivered via a non-physical contact medium, such as wirelessly, optically, sonically, and so forth.

Figure 5:
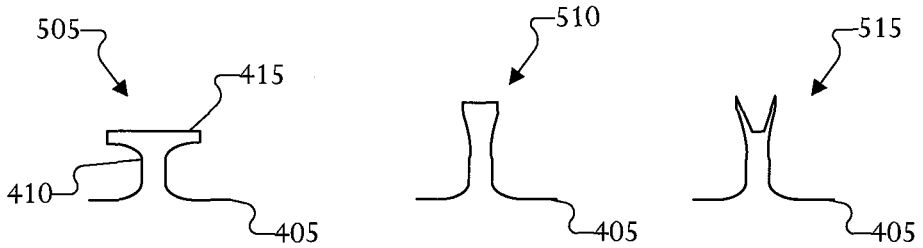
FIGS. 5 and 6 illustrate neutral and deformed states of the island AIF according to the present disclosure.
Figure 6:
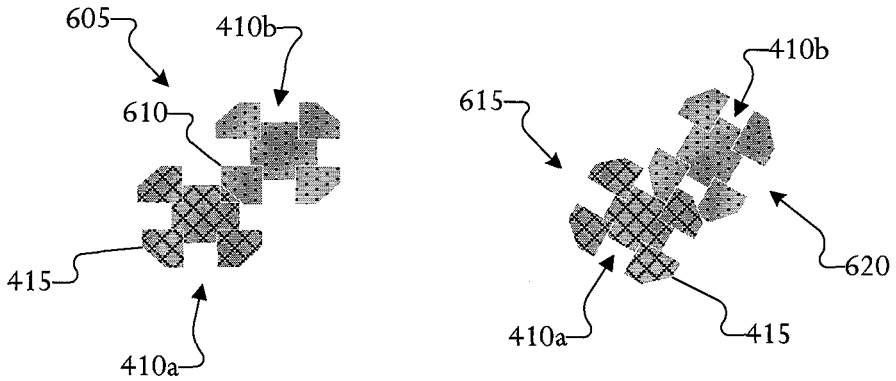

FIGS. 5 and 6 illustrate neutral and deformed states of the island AIF according to the present disclosure. FIG. 5 illustrates vertical deformation of the islands 410 according to the present disclosure. FIG. 6 illustrates rotational deformation of the islands 410 according to the present disclosure. The embodiments of the neutral and deformed states shown in FIGS. 5 and 6 are for illustration only. Other embodiments could be used without departing from the scope of the present disclosure.

In response to the external stimuli received via the activation means 425, one or more of the islands 410 deform. For example, when in a neutral state in which no external stimuli is provided, the islands 410 are in a locking shape 505 such that the islands 410 can mechanically engage with other islands 410. Therefore, in the locking shape 505, the active element is able to form an interlocking connection with the receiving element. In the interlocking connection, the active element is fastened to, or locked with, the receiving element, namely islands 410 of the active element are mechanically coupled with islands 410 on the receiving element, such that considerable separation force is required to sever the mechanical connection between the active element and the receiving element. That is, when in an interlocking connection, the active element and the receiving element maintain a mechanical connection against a separation force, such as up to fifty pounds per square inch, applied to the island AIF 400. When the external stimuli is applied, such as via the activation means 425, the islands 410 deform such that the islands 410 no longer retain locked shape 505 and enter a deformed state in which the islands 410 form a first unlocked shape 510 or a second unlocked shape 515 such that the islands 410 of the active element are unable to mechanically engage the islands 410 of the receiving element. In certain embodiments, the islands 410 are configured to deform into the first unlocked shape 510. In certain embodiments, the islands 410 are configured to deform into the second unlocked shape 515. Therefore, in the deformed state, the active element is unable to form an interlocking connection with the receiving element. In certain embodiments, one or more islands 410 on the active element and one or more islands 410 on the receiving elements deform into an unlocked shape in response to introduction of the external stimuli. In certain embodiments, one or more islands 410 on the active element deform into an unlocked shape in response to introduction of the external stimuli while the islands 410 on the receiving elements remain in the locked shape 505.

In certain embodiments, the islands 410 are in an unlocked shape, either the first unlocked shape 510 or the second unlocked shape 515, while in the neutral state and in the locked shape 505, while in the deformed state. For example, when in a neutral state in which no external stimuli is provided, the islands 410 are in an unlocked shape, either the first unlocked shape 510 or the second unlocked shape 515, such that islands 410 of the active element are unable to mechanically engage with the islands 410 of the receiving element. Therefore, with the islands 410 in the unlocked shape, the active element is unable to form an interlocking connection with the receiving element. When the external stimuli is applied, such as via the activation means 425, the islands 410 deform such that the islands 410 form the locked shape 505 and are able to mechanically engage the islands 410 on another element. Therefore, with the islands 410 in the locked shape 505, the active element is able to form an interlocking connection with the receiving element.

In certain embodiments, the islands 410 deform by rotating in response to the external stimuli received via the activation means 425. For example, when in a neutral state in which no external stimuli is provided, first islands 410*a* are oriented in a first direction 605 such that the first islands 410*a* can mechanically engage with second islands 410*b* on another element that are also aligned in the first direction. That is, at least one locking surfaces 415 on the first islands 410*a* overlaps 610 with at least one locking surface 410 on the second islands 410*b* causing the islands 410 to mechanically interlock. Therefore, when the first islands 410*a* on the active element and the second islands 410*b* on the receiving element are aligned, such as both being aligned in the first direction, the active element is able to form an interlocking connection with the receiving element. In the interlocking connection, the locking surfaces of the islands 410*a*, 410*b* overlap 610 and interlock such that considerable separation force is required to sever the mechanical connection between the active element and the receiving element. That is, when in an interlocking connection, the active element and the receiving element maintain a mechanical connection against a separation force, such as up to fifty pounds per square inch, applied to the island AIF 400. When the external stimuli is applied, such as via the activation means 425, the islands 410*a*, 410*b* rotate such that the locking surfaces 415 no longer overlap and the active element is unable to mechanically engage the receiving element. That is, the first island 410*a* can rotate to a second direction 615 while the second island 410*b* rotates to a third direction 620 such that the locking surfaces 415 no longer overlap. Therefore, in the rotated state, the active element is unable to form an interlocking connection with the receiving element. In certain embodiments, in response to introduction of the external stimuli, the first islands 410*a* on the active element rotate to the second direction 615 while the second islands 410*b* on the receiving element maintain an orientation in the first direction 605.

In certain embodiments, the first islands 410*a* are the rotated in the second direction 615 while in the neutral state and oriented in the first direction 605, while in the deformed state. For example, when in a neutral state in which no external stimuli is provided, the first islands 410*a* oriented in the second direction 615 and the second islands 410*b* can be oriented in the third direction 620, such that first islands 410*a* of the active element are unable to mechanically engage with the second islands 410*b* of the receiving element. Therefore, with the islands 410 in a non-aligning orientation, the respective locking surfaces 415 do not overlap and the active element is unable to form an interlocking connection with the receiving element. When the external stimuli is applied, such as via the activation means 425, the first islands 410*a* deform and rotate into the first direction 605 and the second islands 410*b* rotate and deform into the first direction 605 such that the respective locking surfaces overlap 610 and are able to mechanically engage each other. Therefore, with the respective locking surfaces overlapping 610, the active element is able to form an interlocking connection with the receiving element.

In certain embodiments, separate stimuli are applied to the active element and the receiving element. For example, the active element can receive a first external stimulus via its activation means 425 and the receiving element can receive a second external stimulus via its activation means. In certain embodiments, both the active element and the receiving element receive the same external stimuli via the activation means 425. In certain embodiments, only the active element receives the external stimuli via the activation means 425.

In certain embodiments, the external stimulus is a liquid or chemical applied to the reactive material. When applied the external stimuli causes the reactive material to deform. In certain embodiments, the liquid or chemical is manually removed from the reactive material to return the reactive material to its neutral state. In certain embodiments, as the liquid or chemical evaporates or changes in chemical makeup respectively, the reactive material returns to its neutral state.

Figure 7:
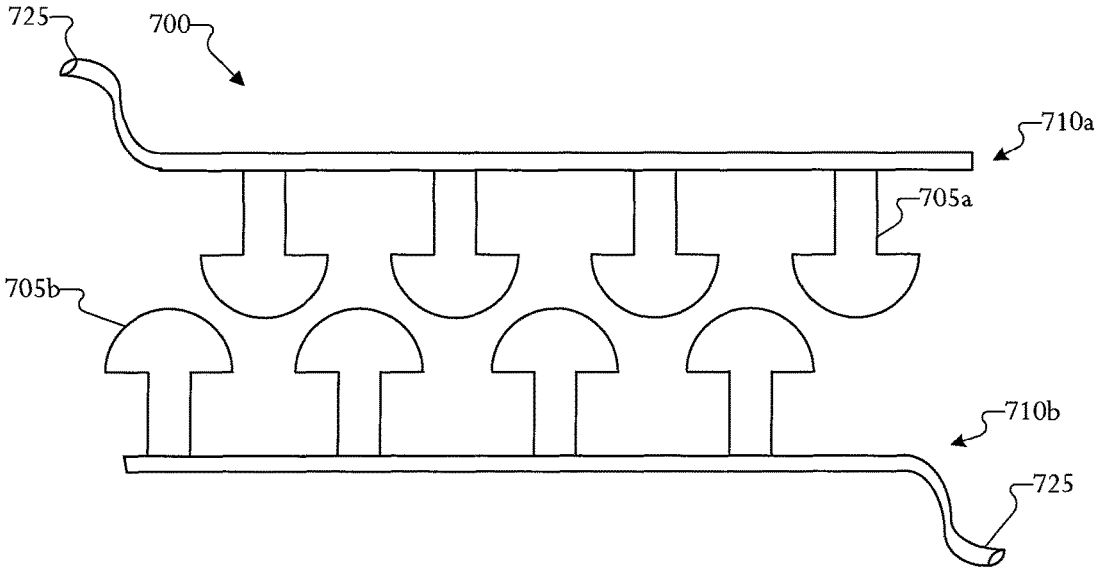
FIGS. 7 and 8 illustrates reclosable active interlocking fastener (AIF) according to the present disclosure.
Figure 8:
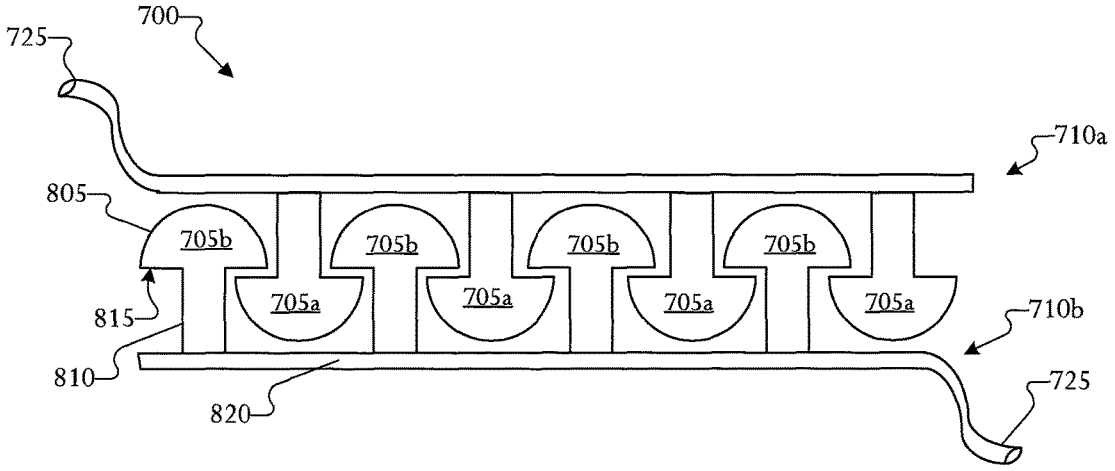

FIGS. 7 and 8 illustrates a reclosable active interlocking fastener (AIF) according to the present disclosure. FIG. 7 illustrates a reclosable AIF in an open position according to the present disclosure. FIG. 8 illustrates a reclosable AIF in a closed position according to the present disclosure. The embodiments of the reclosable AIF 700 shown in FIGS. 7 and 8 are for illustration only. Other embodiments could be used without departing from the scope of this disclosure.

In the example shown in FIG. 7, the reclosable AIF 700 is in an open position. The reclosable AIF 700 includes a plurality of self-engaging prongs 705*a* on a first element 710*a* configured to engage a similar plurality of self-engaging prongs 705*b* on a second element 710*b*. At least one of the first element 710*a* and the second element 710*b* includes an activation means 725 for controlling a deformation of the self-engaging prongs 705*a* on an active element. In certain embodiments, the first element 710*a* and the second element 710*b* are substantially similar, such that both are identical in design and operation. A receiving element is substantially similar to an active element such that both elements are substantially similar to the first element 710*a*. For example, both the receiving element and the active element can be identical to the first element 710*a*. In certain embodiments, both sides, namely both the first element 710*a* and the second element 710*b*, of the reclosable AIF 700 are active elements.

In the example shown in FIG. 8, the reclosable AIF 700 is in a closed position. Each self-engaging prongs 705*a* and 705*b* can be configured substantially the same. Each of the self-engaging prongs 705*a* and 705*b* includes a semispherical bulb 805 coupled to a support stem 810. The semispherical bulb 805 includes a locking surface 815 disposed on an underside of the semispherical bulb 805 and adjacent to the support stem 810. The support stem 810 couples the semispherical bulb 805 to a base 820 of the respective element, such as the second element 710*b*.

In the closed position, one or more locking surfaces 815 on self-engaging prongs 705*a* are mechanically engaged with one or more locking surfaces 815 on self-engaging prongs 705*b*. That is, at least one locking surfaces 815 on self-engaging prongs 705*a* on the first element 710*a* overlaps with at least one locking surface 815 on self-engaging prongs 705*b* of the second element 710*b* causing the self-engaging prongs 705*a* and 705*b* to mechanically interlock. At least one of the first element 710*a* and the second element 710*b* includes an activation means 725 for controlling a deformation of the self-engaging prongs 705*a*. When equipped with the activation means 725, the respective one of the first element 710*a* and the second element 710*b* is configured to operate as an active element. In certain embodiments, both the first element 710*a* and the second element 710*b* include the activation means 725 and, as such, can operate as an active element. In certain embodiments, even though a respective first element 710*a* or the second element 710*b* includes the activation means 725, the respective first element 710*a* and the second element 710*b* is able to operate as a receiving element, that is, can engage with an active element and not necessarily be required to deform.

In certain embodiments, one or more of the self-engaging prongs 705 are formed from a reactive material, such as a material formed from EAPs. In certain embodiments, one or more of the semispherical bulb 805, locking surfaces 815 or support stems 810 are formed from a reactive material, such as a material formed from EAPs. In certain embodiments, the reactive material is formed from stimuli responsive gel. In certain embodiments, the reactive material is formed from another suitable material configured to react to an external stimuli, such as those disclosed herein above. In certain embodiments, one or more of the self-engaging prongs 705*a* and 705*b* are configured to rotate, extend, or deform by straightening, slimming or bending, such that locking surfaces 815 on self-engaging prongs 705*a* do not mechanically engage the locking surfaces 815 on self-engaging prongs 705*b*.

The activation means 725 can include one or more of: an electrical signal; a magnetic force; a temperature signal, such as applied heat above a certain threshold temperature or applied coolness below a threshold temperature; a fluid, such as water, saline, or another liquid; a chemical; light; or sound, such as a tone at specific amplitude or frequency, or both. The activation means 725 delivers a stimulus to self-engaging prongs 705*a*, self-engaging prongs 705*b*, or both. In certain embodiments, the activation means 725 includes a physical carrier structure, such as a tube, conductor, or other transmission conduit. In certain embodiments, the stimulus is delivered via a non-physical contact medium, such as wirelessly, optically, sonically, and so forth.

Figure 9:
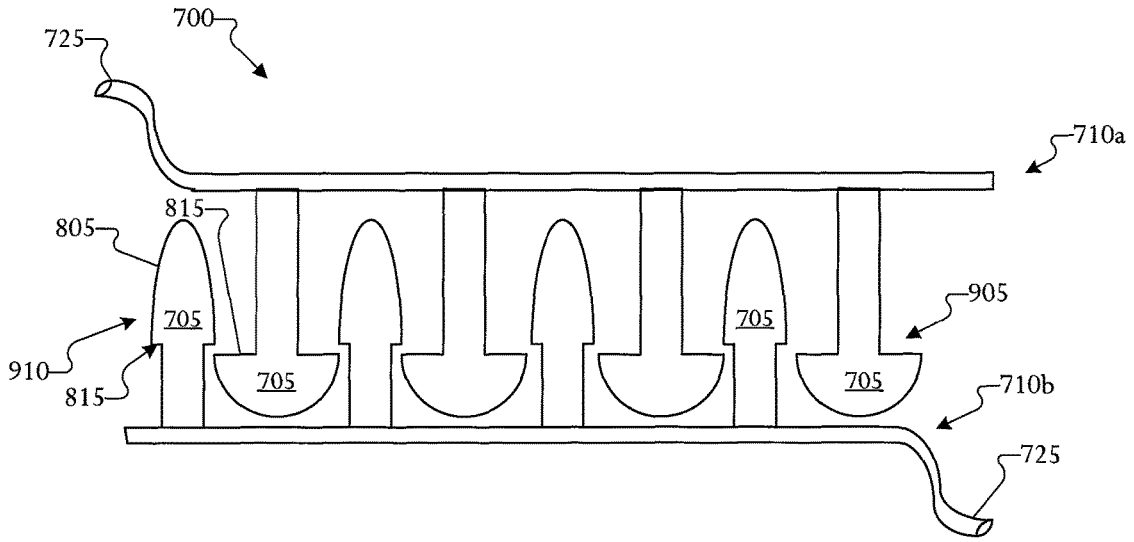
FIGS. 9 and 10 illustrate neutral and deformed states of the reclosable AIF according to the present disclosure.
Figure 10:
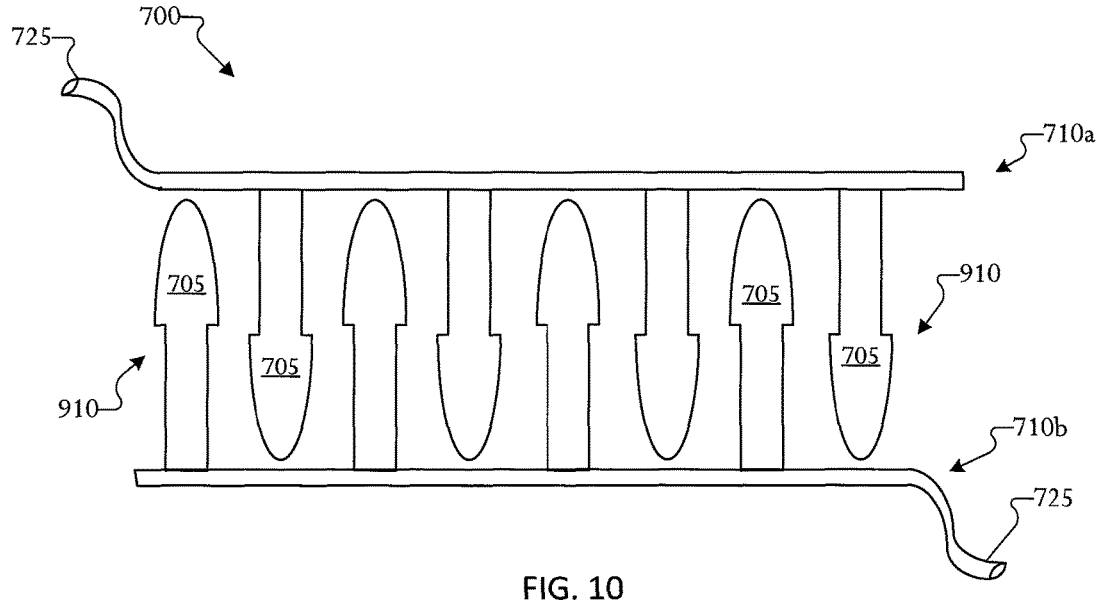

FIGS. 9 and 10 illustrate neutral and deformed states of the reclosable AIF according to the present disclosure. FIG. 9 illustrates deformation of self-engaging prongs 705 on one element and a neutral according to the present disclosure. FIG. 10 illustrates deformation of self-engaging prongs 705 on both elements according to the present disclosure. The embodiments of the neutral and deformed states shown in FIGS. 9 and 10 are for illustration only. Other embodiments could be used without departing from the scope of the present disclosure.

In response to the external stimuli received via the activation means 725, one or more of the self-engaging prongs 705 deform. For example, when in a neutral state in which no external stimuli is provided, the self-engaging prongs 705 are in a locking shape 905 such that the locking surfaces 815 can mechanically engage with other locking surfaces 815. Therefore, in the locking shape 905, the first element 710*a* is able to form an interlocking connection with the second element 710*b*. In the interlocking connection, an active element is fastened to, or locked with, the receiving element, namely locking surfaces 815 of the self-engaging prongs 705 on the active element are mechanically coupled with locking surfaces 815 of the self-engaging prongs 705 on the receiving element, such that considerable separation force is required to sever the mechanical connection between the active element and the receiving element. That is, when in an interlocking connection, the active element and the receiving element maintain a mechanical connection against a separation force, such as up to fifty pounds per square inch, applied to the reclosable AIF 700. When the external stimuli is applied, such as via the activation means 725, the semi-spherical bulbs 805 deform such that the locking surfaces 815 are reduced or bent such that the self-engaging prongs 705 no longer retain locked shape 905 and enter an unlocked state 910, in which the locking surfaces 815 are unable to mechanically engage the locking surfaces 815 the self-engaging prongs 705 on the receiving element. Therefore, in the unlocked state 910, the second element 710*b* is unable to form an interlocking connection with the first element 710*a*.

In the example shown in FIG. 10, one or more self-engaging prongs 705 on the first element 710*a* and self-engaging prongs 705 on the second element 710*b* deform into an unlocked shape 910 in response to introduction of the external stimuli. In response to introduction of the external stimuli, the self-engaging prongs 705 on both the first element 710*a* and the second element 710*b* deform into the unlocked state 910. Because the self-engaging prongs 705 on both the first element 710*a* and the second element 710*b* deform, minimal deformation can be required in order to enable separation in response to a low threshold separation force, such as less than one pound per square inch. In certain embodiments, an amount of the external stimuli can be incrementally applied to vary the separation force required to separate the first element 710*a* from the second element 710*b*. For example, incremental values of the external stimuli can be applied to achieve respective incremental values of the separation force required, such as on one-pound per square inch increments. In certain embodiments, the incremental value is higher than one-pound per square inch increments. In certain embodiments, the incremental value is less than one-pound per square inch increments. In certain embodiments, the incremental value for varying the separation force is proportional to the incremental value of external stimuli applied.

In certain embodiments, the self-engaging prongs 705 are in an unlocked shape 910 while in the neutral state and in the locked shape 905, while in the deformed state. For example, when in a neutral state, in which no external stimuli is provided, the self-engaging prongs 705 are in an unlocked shape 910 such that the locking surfaces 815 of the self-engaging prongs 705 of the first element 710*a* are unable to mechanically engage with the locking surfaces 815 of the self-engaging prongs 705 of the second element 710*b*. Therefore, with the self-engaging prongs 705 in the unlocked shape 910, an interlocking connection between the first element 710*a* and the second element 710*b* cannot be formed. When the external stimuli is applied, such as via the activation means 725, the self-engaging prongs 705 deform such that the self-engaging prongs 705 form the locked shape 905 and are able to mechanically engage the self-engaging prongs 705 on another element. That is, in response to the external stimuli, locking surfaces 815 extend or stiffen and spherical bulbs 805 are roundly formed. Therefore, with the self-engaging prongs 705 in the locked shape 905 in response to the external interface being applied, the first element 710*a* is able to form an interlocking connection with the second element 710*b*. In certain embodiments, an amount of the external stimuli can be incrementally applied to vary the separation force required to separate the first element 710*a* from the second element 710*b*.

In certain embodiments, separate stimuli are applied to the first element 710*a* and the second element 710*b*. For example, the first element 710*a* can receive a first external stimulus via its activation means 725 and the second element 710*b* can receive a second external stimulus via its activation means. In certain embodiments, both the first element 710*a* and the second element 710*b* receive the same external stimuli via the activation means 725. In certain embodiments, only the first element 710*a* receives the external stimuli via the activation means 725.

In certain embodiments, the external stimulus is a liquid or chemical applied to the reactive material. When applied the external stimuli causes the reactive material to deform. In certain embodiments, the liquid or chemical is manually removed from the reactive material to return the reactive material to its neutral state. In certain embodiments, as the liquid or chemical evaporates or changes in chemical makeup respectively, the reactive material returns to its neutral state.

Figure 11:
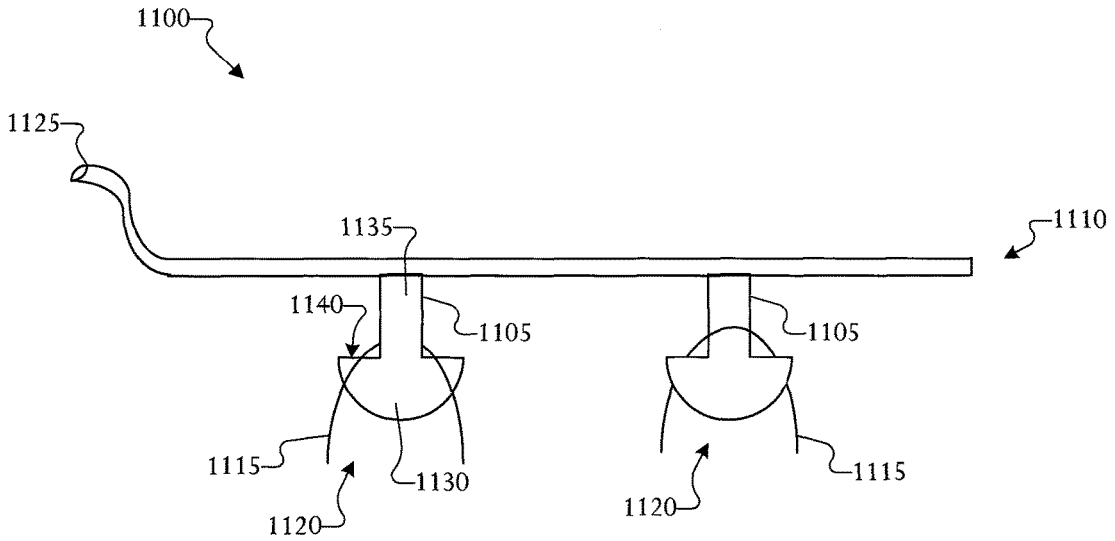
FIGS. 11 and 12 illustrates reclosable active interlocking fastener (AIF) interlocking a woven fiber according to the present disclosure.
Figure 12:
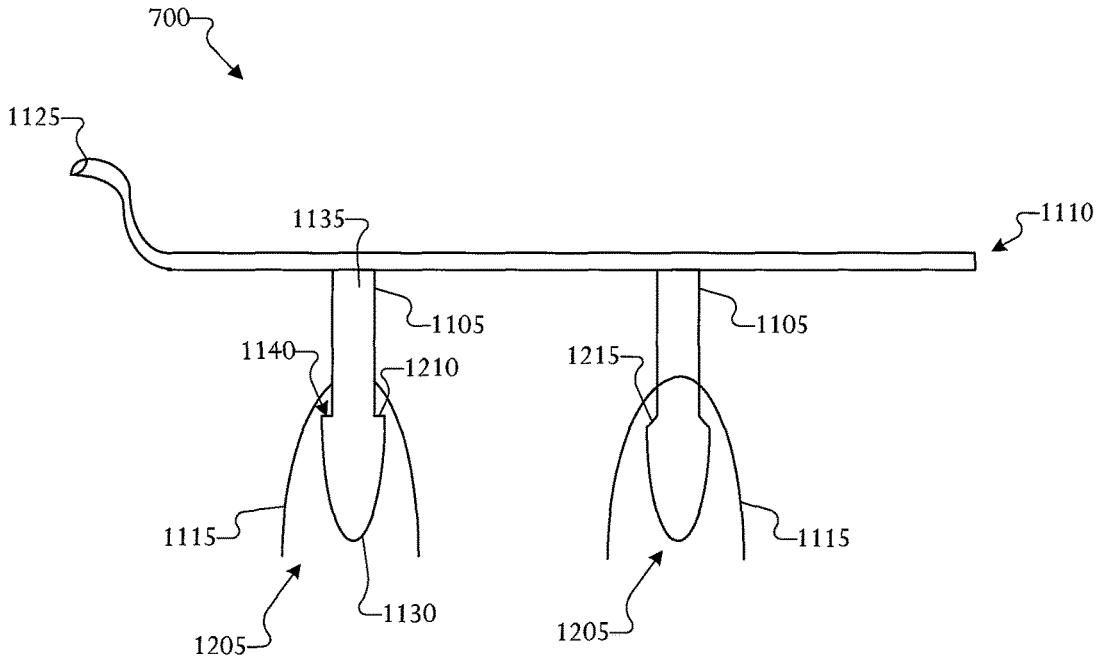

FIGS. 11 and 12 illustrates reclosable active interlocking fastener (AIF) interlocking a woven fiber according to the present disclosure. FIG. 11 illustrates the reclosable AIF in a locked state according to the present disclosure. FIG. 12 illustrates the reclosable AIF in an unlocked state according to the present disclosure. The embodiments of the reclosable AIF 1100 shown in FIGS. 11 and 12 are for illustration only. Other embodiments could be used without departing from the scope of this disclosure. The reclosable AIF 1100 can be configured the same as, or substantially similar to, one of the elements for the reclosable AIF 700.

In the example shown in FIG. 11, the reclosable AIF 1100 is interlocked with a woven fabric. The woven fabric can comprise any suitable material or any suitable weave for establishing an interlock. The reclosable AIF 1100 includes a plurality of self-engaging prongs 1105 on a first element 1110 configured to engage one or more loops 1115 on the woven fabric when the self-engaging prongs 1105 are in a locking state 1120. The first element 1110 includes an activation means 1125 for controlling a deformation of the self-engaging prongs 1105. Each of the self-engaging prongs 1105 includes a semispherical bulb 1130 coupled to a support stem 1135. The semispherical bulb 1130 includes a locking surface 1140 disposed on an underside of the semispherical bulb 1130 and adjacent to the support stem 1135. The support stem 1135 couples the semispherical bulb 1130 to the first element 1110.

As the reclosable AIF 1100 is brought within a close proximity such that at least one of the loops 1115 is able to mechanically engage the locking surface 1140 of at least one of the self-engaging prongs 1105. That is, as the reclosable AIF 1100 is brought within a distance such that at least one of the loops 1115 is able to wrap around the self-engaging prongs 1105, the reclosable AIF 1100 interlocks with the woven fiber. The self-engaging prongs 1105 are configured such that the loops 1115 slide, or otherwise move, over the spherical bulb 1130, wrap around the support stem 1135 and are restrained by the locking surface 1140 such the loop 1115 cannot be readily drawn away from the self-engaging prongs 1105 without application of a sufficient separation force. The separation force can be dependent upon a strength of the woven fabric. For example, depending upon the fibers in the woven fabric, the separation force required to mechanically disengage the loops 1115 from the self-engaging prongs 1105 can be over fifty pounds per square inch and may cause damage such as shearing or tearing of the loops 1115 from the woven fabric.

In certain embodiments, one or more of the self-engaging prongs 1105 are formed from a reactive material, such as a material formed from EAPs. In certain embodiments, one or more of the semispherical bulb 1130, locking surfaces 1140 or support stems 1135 are formed from a reactive material, such as a material formed from EAPs. In certain embodiments, the reactive material is formed from stimuli responsive gel. In certain embodiments, the reactive material is formed from another suitable material configured to react to an external stimuli, such as those disclosed herein above. In certain embodiments, one or more of the self-engaging prongs 1105 are configured to rotate, extend, or deform by straightening, slimming or bending, such that locking surfaces 1140 on self-engaging prongs 1105 do not mechanically engage the loops 1115.

In the example shown in FIG. 12, the reclosable AIF 1100 is in a non-interlock state 1205 in which the reclosable AIF 1100 is configured to not mechanically engage the woven fibers. In response to introduction of the external stimuli via the activation means 1125, one or more self-engaging prongs 1105 deform such that the locking surfaces 1140 do not mechanically engage, namely snag or hook, the loops 1115. When in the non-interlock state 1205, one or more of the semispherical bulb 1130, locking surfaces 1140 or support stems 1135 bend, twist or elongate such that the locking surfaces 1140 are unable to restrain the loops 1115. For example, the semispherical bulb 1130 can elongate and narrow such that the locking surfaces 1140 either completely disappear or are reduced in dimension 1210 below that which is required to hold the loops 1115, such as a lateral dimension less than half a diameter of a fiber of the loop 1115. In another example, the semispherical bulb 1130 elongates and narrows causing the locking surfaces 1140 to angle away 1215 from the support stem 1135 such that the locking surfaces 1140 do not mechanically engage, namely snag or hook, the loops 1115; but rather, the loops 1115 slide or slip over the locking surfaces 1140 with minimal resistance.

In certain embodiments, the self-engaging prongs 1105 are in a non-interlock state 1205 while in the neutral state, namely without an external stimuli, and in the locking state 1120 in response to the external stimuli. For example, when in a neutral state, in which no external stimuli is provided, the self-engaging prongs 1105 are in the non-interlock state 1205 such that the locking surfaces 1140 of the self-engaging prongs 1105 are unable to mechanically engage with the loops 1115. Therefore, with the self-engaging prongs 1105 in the non-interlock state 1205, an interlocking connection between the first element 1110 and the woven fabric cannot be formed. When the external stimuli is applied, such as via the activation means 1125, the self-engaging prongs 1105 deform such that the self-engaging prongs 1105 form the locked shape of the locking state 1120 and are able to mechanically engage the loops 1115 of the woven fabric. That is, in response to the external stimuli, locking surfaces 1140 extend, straighten or stiffen and spherical bulbs 1130 are roundly formed. Therefore, with the self-engaging prongs 1105 in the locking state 1120 in response to the external interface being applied, the first element 1110 is able to form an interlocking connection with the woven fabric. In certain embodiments, an amount of the external stimuli can be incrementally applied to vary the separation force required to separate the first element 1110 from the woven fabric.

The activation means 1125 can include one or more of: an electrical signal; a magnetic force; a temperature signal, such as applied heat above a certain threshold temperature or applied coolness below a threshold temperature; a fluid, such as water, saline, or another liquid; a chemical; light; or sound, such as a tone at specific amplitude or frequency, or both. The activation means 1125 delivers a stimulus to self-engaging prongs 1105. In certain embodiments, the activation means 1125 includes a physical carrier structure, such as a tube, conductor, or other transmission conduit. In certain embodiments, the stimulus is delivered via a non-physical contact medium, such as wirelessly, optically, sonically, and so forth.

In certain embodiments, the external stimulus is a liquid or chemical applied to the reactive material. When applied the external stimuli causes the reactive material to deform. In certain embodiments, the liquid or chemical is manually removed from the reactive material to return the reactive material to its neutral state. In certain embodiments, as the liquid or chemical evaporates or changes in chemical makeup respectively, the reactive material returns to its neutral state.

Figure 13:
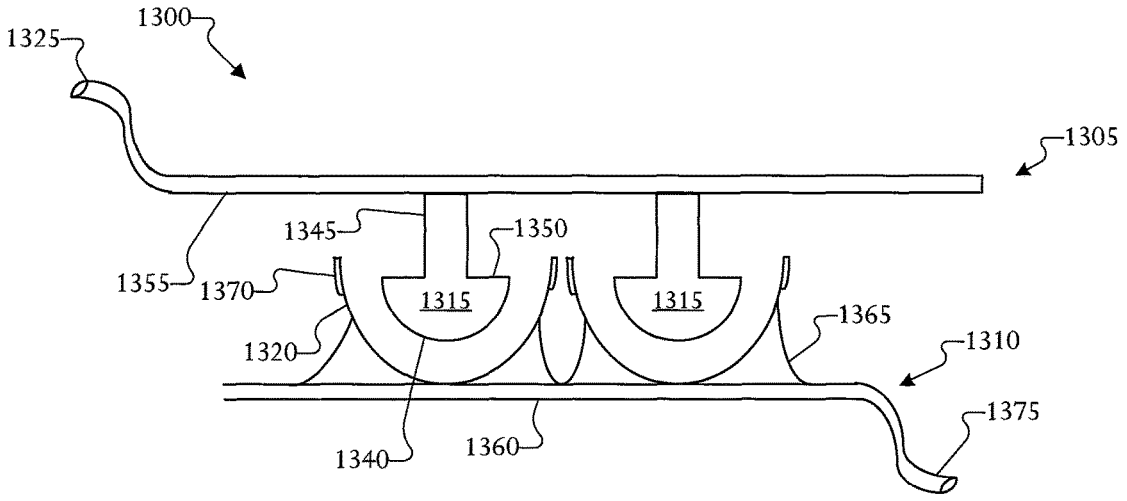
FIGS. 13 and 14 illustrates spherical active interlocking fastener (AIF) according to the present disclosure.
Figure 14:
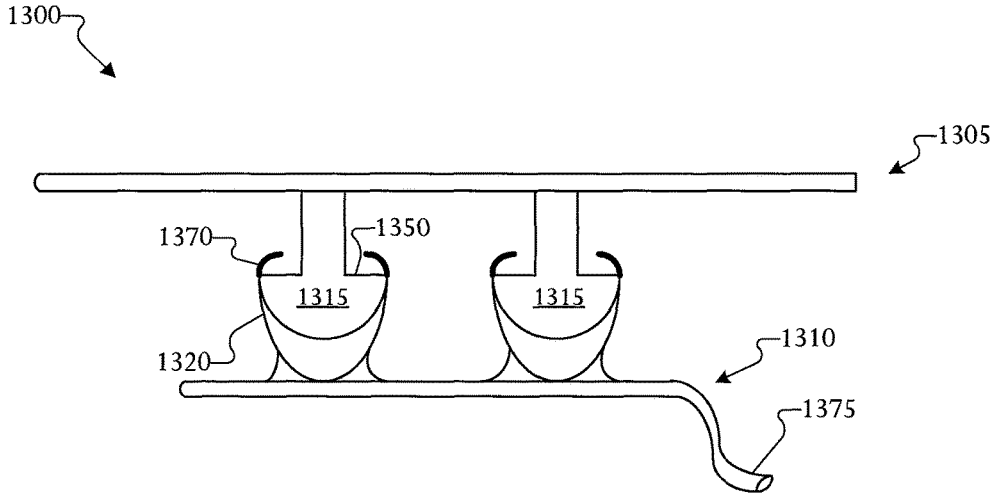

FIGS. 13 and 14 illustrates spherical active interlocking fastener (AIF) according to the present disclosure. FIG. 13 illustrates the spherical reclosable AIF 1300 in an un-locked state according to the present disclosure. FIG. 14 illustrates the spherical reclosable AIF 1300 in a locked state according to the present disclosure. The embodiments of the spherical reclosable AIF 1300 shown in FIGS. 13 and 14 are for illustration only. Other embodiments could be used without departing from the scope of this disclosure.

In the example shown in FIG. 13, the spherical reclosable AIF 1300 includes a prong element 1305 adapted to interlock with a reclosable-cup element 1310. The prong element 1305 includes a plurality of engaging prongs 1315 configured to align with and engage respective cups 1320 on the reclosable-cup element 1310. In certain embodiments, the prong element 1305 includes an activation means 1325 for controlling a deformation of the engaging prongs 1315. In certain embodiments, the prong element 1305 is configured the same as, or substantially similar to, one of the elements for the reclosable AIF 700. Each of the engaging prongs 1315 includes a semispherical bulb 1340 coupled to a support stem 1345. The semispherical bulb 1340 includes a locking surface 1350 disposed on an underside of the semispherical bulb 1340 and adjacent to the support stem 1345. The support stem 1340 couples the semispherical bulb 1340 to a base 1355 of the prong element 1305. In certain embodiments, the prong element 1305 does not include an activation means 1325 such that the engaging prongs 1315 may not deform in response to one of the aforementioned external stimuli.

The reclosable-cup element 1310 includes a plurality of cups 1320. Each of the cups 1320 is dimensioned and positioned to align with, and couple to, respective ones of the engaging prongs 1315 on the prong element 1305. The cups 1320 are coupled to a base 1360 of the reclosable-cup element 1310. For example, each cup 1320 can be coupled to the base 1360 through a support mounting or molding 1365. Each of the cups includes control element 1370 formed from a reactive material. In certain embodiments, the entire cup 1320 is formed from the reactive material, such that the control element 1370 comprises the entire cup 1320. The reclosable-cup element 1310 also includes an activation means 1370 configured to receive an external stimuli and deliver the external stimuli to the control elements 1370.

In certain embodiments, one or more of the cups 1320 are formed from a reactive material, such as a material formed from EAPs. In certain embodiments, one or more of the control elements 1370 are formed from a reactive material, such as a material formed from EAPs. In certain embodiments, the reactive material is formed from stimuli responsive gel. In certain embodiments, the reactive material is formed from another suitable material configured to react to an external stimuli, such as those disclosed herein above. In certain embodiments, one or more of the engaging prongs 1315 are configured to rotate, extend, or deform by straightening, slimming or bending, such that locking surfaces 1350 on engaging prongs 1315 do not mechanically engage the cups 1320.

The cups 1320 are substantially spherical with an open end configured to receive a respective engaging prong 1315. The control element 1370 is disposed on an inner or outer surface of the cup 1320. In certain embodiments, the control element 1370 comprises a rim edge of the cup 1320. The control element 1370 is configured to constrict in response to introduction of the external stimuli via the activation means 1375. When constricting, the control element 1370 causes the cup 1370 to deform around the engaging prong 1315.

As shown in the example shown in FIG. 14, the prong element 1305 is brought within a close proximity to the reclosable-cup element 1310 such that at least one of the cups 1320 is able to mechanically engage the locking surface 1140 of at least one of the engaging prongs 1315. That is, as the prong element 1305 is brought within a distance such that a control element 170 of the cups 1320 is able to constrict around the engaging prongs 1315, such the control element 1370 is unable to slide or slip over the locking surface 1350. When constricted, the cups 1320 cannot be readily drawn away from the engaging prongs 1105 without application of a sufficient separation force. For example, depending upon the material used to form the engaging prongs 1315, the separation force required to mechanically disengage the cups 1320 from the engaging prongs 1315 can be over fifty pounds per square inch and may cause damage such as shearing or breaking of the engaging prongs 1315.

In certain embodiments, the cups 1320 are constricted while in the deformed state, namely in response to an external stimuli, and unconstrict or open in a neutral state, namely without an external stimuli. For example, when in a neutral state, in which no external stimuli is provided, the cups 1320 are in an open or un-constricted state such that the control elements 1370 do not mechanically engage with the engaging prongs 1315. Therefore, when the control elements 1370 of the cups 1320 are un-constricted or open, an interlocking connection between the reclosable-cup element 1310 and the prong element 1305 is not formed. When the external stimuli is applied, such as via the activation means 1375, the control elements 1370 deform, constrict or close such that the cups 1320 are able to mechanically engage the locking surfaces 1350 of the engaging prongs 1315. That is, in response to introduction of the external stimuli, the cups 1320 close and are constricted as shown in the example illustrated in FIG. 14. Therefore, when the control elements 1370 of the cups 1320 are constricted, an interlocking connection between the reclosable-cup element 1310 and the prong element 1305 is formed. In certain embodiments, an amount of the external stimuli can be incrementally applied to vary the separation force required to separate the reclosable-cup element 1310 from the prong element 1305.

In certain embodiments, the cups 1320 are constricted while in the neutral state, namely without an external stimuli, and unconstrict or open in response to the external stimuli. For example, when in a neutral state, in which no external stimulus is provided, the cups 1320 are in an interlock state such that the control elements 1370 mechanically engage with the engaging prongs 1315. Therefore, when the control elements 1370 of the cups 1320 are constricted, an interlocking connection between the reclosable-cup element 1310 and the prong element 1305 is formed. When the external stimuli is applied, such as via the activation means 1375, the control elements 1370 deform, de-constrict or open such that the cups 1320 are unable to mechanically engage the locking surfaces 1350 of the engaging prongs 1315. That is, in response to introduction of the external stimulus, the cups 1320 open and roundly form as shown in the example illustrated in FIG. 13. Therefore, when the control elements 1370 of the cups 1320 are un-constricted or open, an interlocking connection between the reclosable-cup element 1310 and the prong element 1305 is not formed. In certain embodiments, an amount of the external stimuli can be incrementally applied to vary the separation force required to separate the reclosable-cup element 1310 from the prong element 1305.

The activation means 1375 can include one or more of: an electrical signal; a magnetic force; a temperature signal, such as applied heat above a certain threshold temperature or applied coolness below a threshold temperature; a fluid, such as water, saline, or another liquid; a chemical; light; or sound, such as a tone at specific amplitude or frequency, or both. The activation means 1375 delivers a stimulus to control elements 1370. In certain embodiments, the activation means 1375 includes a physical carrier structure, such as a tube, conductor, or other transmission conduit. In certain embodiments, the stimulus is delivered via a non-physical contact medium, such as wirelessly, optically, sonically, and so forth.

In certain embodiments, the external stimulus is a liquid or chemical applied to the reactive material. When applied the external stimuli causes the reactive material to deform. In certain embodiments, the liquid or chemical is manually removed from the reactive material to return the reactive material to its neutral state. In certain embodiments, as the liquid or chemical evaporates or changes in chemical makeup respectively, the reactive material returns to its neutral state.

Figure 15:
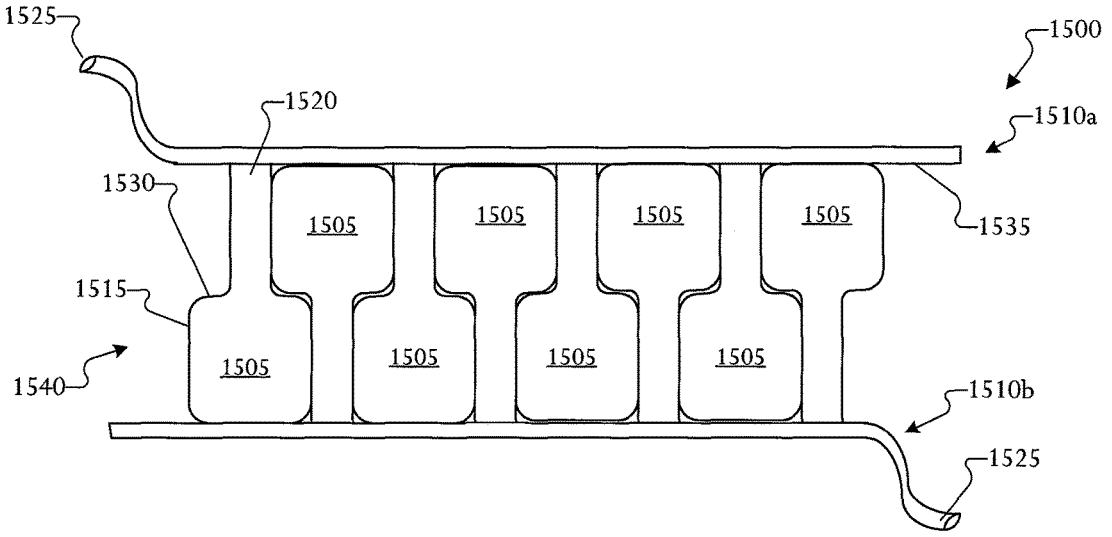
FIGS. 15 and 16 illustrates another reclosable active interlocking fastener (AIF) according to the present disclosure.
Figure 16:
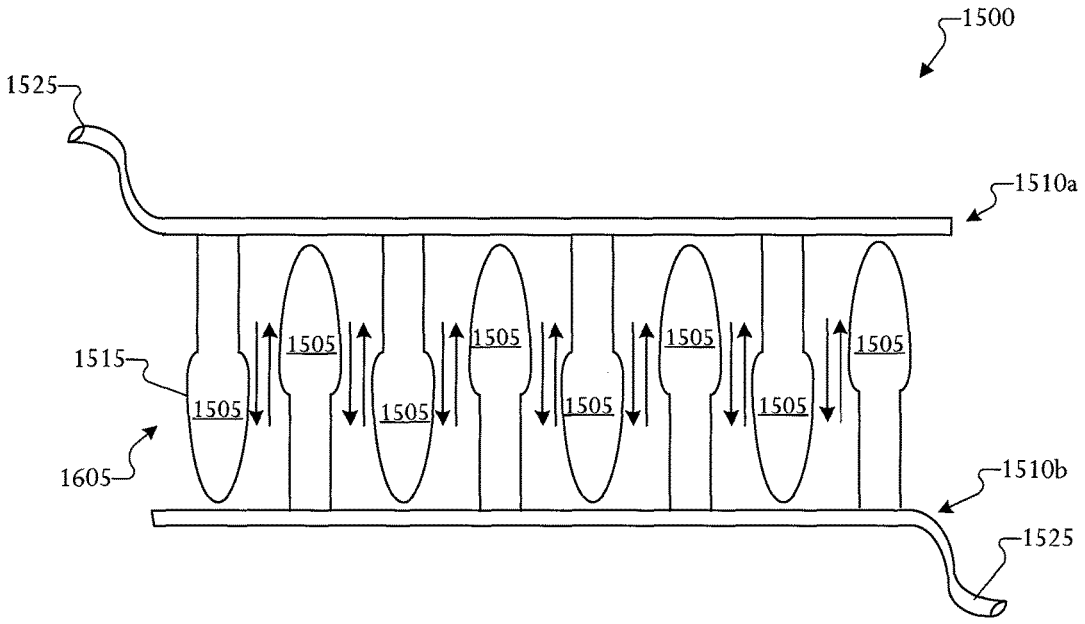

FIGS. 15 and 16 illustrates another reclosable active interlocking fastener (AIF) according to the present disclosure. FIG. 15 illustrates a reclosable AIF in a closed position according to the present disclosure. FIG. 16 illustrates a reclosable AIF in an open position according to the present disclosure. The embodiments of the reclosable AIF 1500 shown in FIGS. 15 and 16 are for illustration only. Other embodiments could be used without departing from the scope of this disclosure.

In the example shown in FIG. 15, the reclosable AIF 1500 is in a closed, or interlocked, position. The reclosable AIF 1500 includes a plurality of self-engaging prongs 1505 on a first element 1510*a* configured to engage a similar plurality of self-engaging prongs 1505 on a second element 1510*b*. At least one of the first element 1510*a* and the second element 1510*b* includes an activation means 1525 for controlling a deformation of the self-engaging prongs 1505 on an active element. That is, in certain embodiments, both the first element 1510*a* and the second element 1510*b* include an activation means 1525 for controlling a deformation of the self-engaging prongs 1505. In certain embodiments, only the first element 1510*a* includes an activation means 1525 for controlling a deformation of the self-engaging prongs 1505. In certain embodiments, the first element 1510*a* and the second element 1510*b* are substantially similar, such that both are identical in design and operation. A receiving element is substantially similar to an active element such that both elements are substantially similar to the first element 1510*a*. For example, both the receiving element and the active element can be identical to the first element 1510*a*. In certain embodiments, both sides, namely both the first element 1510*a* and the second element 1510*b*, of the reclosable AIF 1500 are active elements.

Each self-engaging prongs 1505 can be configured substantially the same. Each of the self-engaging prongs 1505 includes a protrusion or bulb 1515 coupled to a support stem 1520. The bulb 1515 includes a locking surface 1530 disposed on an underside of the bulb 1515 and adjacent to the support stem 1520. The support stem 1510 couples the bulb 1515 to a base 1535 of the respective element, such as the second element 1510*a*.

In the closed position, one or more locking surfaces 1530 on self-engaging prongs 1505 of the first element 1510*a* are mechanically engaged with one or more locking surfaces 1530 on self-engaging prongs 1505 of the second element 1510*b*. That is, at least one locking surfaces 1530 on self-engaging prongs 1505 on the first element 1510*a* overlaps with at least one locking surface 1530 on self-engaging prongs 1505 of the second element 1510*b* causing the self-engaging prongs 1505 to mechanically interlock. At least one of the first element 1510*a* and the second element 1510*b* includes an activation means 1525 for controlling a deformation of the self-engaging prongs 1505. When equipped with the activation means 1525, the respective one of the first element 1510*a* and the second element 1510*b* is configured to operate as an active element. In certain embodiments, both the first element 1510*a* and the second element 1510*b* include the activation means 1525 and, as such, can operate as an active element. In certain embodiments, even though a respective first element 1510*a* or the second element 1510*b* includes the activation means 1525, the respective first element 1510*a* and the second element 1510*b* is able to operate as a receiving element, that is, can engage with an active element and not necessarily be required to deform.

In certain embodiments, when interlocked, the self-engaging prongs 1505 of the reclosable AIF 1500 are configured to form a fluid tight seal, such as one or more of: an air-tight seal, water-tight seal or weather seal. That is, the surfaces of the self-engaging prongs 1505 contact each other to inhibit a flow of one or more of: air, water, or another gas or fluid. For example, one or more surfaces of the bulbs 1515 contact respective surfaces of the step 1520 and a locking surface 1530 of another self-engaging prong 1505. Although the example shown in FIG. 15 illustrates a separation between certain surfaces of the self-engaging prongs 1505, such is for illustration only and embodiments in which no discernable separation exists, namely respective surfaces of the self-engaging prongs 1505 physically contact each other leaving no visible, apparent or accessible gap, between the self-engaging prongs 1505 are within the scope of the present disclosure.

In certain embodiments, one or more of the self-engaging prongs 1505 are formed from a reactive material, such as a material formed from EAPs. In certain embodiments, one or more of the bulb 1515, locking surfaces 1530 or support stems 1520 are formed from a reactive material, such as a material formed from EAPs. In certain embodiments, the reactive material is formed from stimuli responsive gel. In certain embodiments, the reactive material is formed from another suitable material configured to react to an external stimuli, such as those disclosed herein above. In certain embodiments, one or more of the self-engaging prongs 1505 are configured to rotate, extend, or deform by straightening, slimming or bending, such that locking surfaces 1530 on self-engaging prongs 1505 on the first element 1510*a* do not mechanically engage the locking surfaces 1530 on self-engaging prongs 1505 on the second element 1510*b*.

The activation means 1525 can include one or more of: an electrical signal; a magnetic force; a temperature signal, such as applied heat above a certain threshold temperature or applied coolness below a threshold temperature; a fluid, such as water, saline, or another liquid; a chemical; light; or sound, such as a tone at specific amplitude or frequency, or both. The activation means 1525 delivers a stimulus to self-engaging prongs 1505 on the first element 1510*a*, self-engaging prongs 1505 on the second element 1510*b*, or both. In certain embodiments, the activation means 1525 includes a physical carrier structure, such as a tube, conductor, or other transmission conduit. In certain embodiments, the stimulus is delivered via a non-physical contact medium, such as wirelessly, optically, sonically, and so forth.

In the example shown in FIG. 16 the self-engaging prongs 1505 have transitioned to a state in which interlocking does not occur. In certain embodiments, the self-engaging prongs 1505 are capable of interlocking in a neutral state shown in FIG. 15 and deform in response to an external stimuli to transition into the non-interlocking shape 1605 shown in FIG. 16. In certain embodiments, the self-engaging prongs 1505 are in the non-interlocking shape 1605 in a neutral state shown in FIG. 16 and deform in response to an external stimuli to transition into the interlocking shape 1540 shown in FIG. 15. The embodiments of the neutral and deformed states shown in FIGS. 15 and 16 are for illustration only. Other embodiments could be used without departing from the scope of the present disclosure.

In response to the external stimuli received via the activation means 1525, one or more of the self-engaging prongs 1505 deform. For example, when in a neutral state in which no external stimuli is provided, the self-engaging prongs 1505 are in a locking shape 1540 such that the locking surfaces 1530 can mechanically engage with other locking surfaces 1530. Therefore, in the locking shape 1540, the first element 1510*a* is able to form an interlocking connection or a weather-tight seal, or a combination thereof, with the second element 1510*b*. In the interlocking connection, an active element is fastened to, or locked with, the receiving element, namely locking surfaces 1530 of the self-engaging prongs 1505 on the active element are mechanically coupled with locking surfaces 1530 of the self-engaging prongs 1505 on the receiving element, such that considerable separation force is required to sever the mechanical connection between the active element and the receiving element. That is, when in an interlocking connection, the active element and the receiving element maintain a mechanical connection against a separation force, such as up to fifty pounds per square inch, applied to the reclosable AIF 1500. When the external stimuli is applied, such as via the activation means 1525, the bulbs 1515 deform such that the locking surfaces 1530 are reduced, eliminated or bent such that the self-engaging prongs 1505 no longer retain locked shape 1540 and enter non-interlocking shape 1605, in which the locking surfaces 1530 are unable to mechanically engage the locking surfaces 1530 the self-engaging prongs 1505 on the receiving element. Therefore, in the unlocked shape 1605, the second element 1510*b* is unable to form an interlocking connection with the first element 1510*a*.

In the example shown in FIG. 16, one or more self-engaging prongs 705 on the first element 710*a* and self-engaging prongs 705 on the second element 710*b* deform into an unlocked shape 1605 in response to introduction of the external stimuli. In response to introduction of the external stimuli, the self-engaging prongs 1505 on both the first element 1510*a* and the second element 1510*b* deform into the non-interlocking shape 1605. Because the self-engaging prongs 1505 on both the first element 1510*a* and the second element 1510*b* deform, minimal deformation can be required in order to enable separation in response to a low threshold separation force, such as less than one pound per square inch. In certain embodiments, an amount of the external stimuli can be incrementally applied to vary the separation force required to separate the first element 1510*a* from the second element 1510*b*. For example, incremental values of the external stimuli can be applied to achieve respective incremental values of the separation force required, such as on one-pound per square inch increments. In certain embodiments, the incremental value is higher than one-pound per square inch increments. In certain embodiments, the incremental value is less than one-pound per square inch increments. In certain embodiments, the incremental value for varying the separation force is proportional to the incremental value of external stimuli applied.

In certain embodiments, the self-engaging prongs 1505 are in an non-interlocking shape 1605 while in the neutral state and in the locked shape 1540 while in the deformed state. For example, when in a neutral state, in which no external stimuli is provided, the self-engaging prongs 1505 are in the non-interlocking shape 1605 such that the locking surfaces 1530 of the self-engaging prongs 1505 of the first element 1510*a* are unable to mechanically engage with the locking surfaces 1530 of the self-engaging prongs 1505 of the second element 1510*b*. Therefore, with the self-engaging prongs 1505 in the non-interlocking shape 1605, an interlocking connection between the first element 1510*a* and the second element 1510*b* cannot be formed. When the external stimuli is applied, such as via the activation means 1525, the self-engaging prongs 1505 deform such that the self-engaging prongs 1505 form the locked shape 1540 and are able to mechanically engage the self-engaging prongs 1505 on another element. That is, in response to the external stimuli, locking surfaces 1530 extend or stiffen and bulbs 1515 are expansively formed. Therefore, with the self-engaging prongs 1505 in the locked shape 1540 in response to the external interface being applied, the first element 1510*a* is able to form an interlocking connection with the second element 1510*b*. In certain embodiments, an amount of the external stimuli can be incrementally applied to vary the separation force required to separate the first element 1510*a* from the second element 1510*b*.

In certain embodiments, separate stimuli are applied to the first element 1510*a* and the second element 1510*b*. For example, the first element 1510*a* can receive a first external stimulus via its activation means 1525 and the second element 1510*b* can receive a second external stimulus via its activation means. In certain embodiments, both the first element 1510*a* and the second element 1510*b* receive the same external stimuli via the activation means 1525. In certain embodiments, only the first element 1510*a* receives the external stimuli via the activation means 1525.

In certain embodiments, the external stimulus is a liquid or chemical applied to the reactive material. When applied the external stimuli causes the reactive material to deform. In certain embodiments, the liquid or chemical is manually removed from the reactive material to return the reactive material to its neutral state. In certain embodiments, as the liquid or chemical evaporates or changes in chemical makeup respectively, the reactive material returns to its neutral state.

Figure 17:
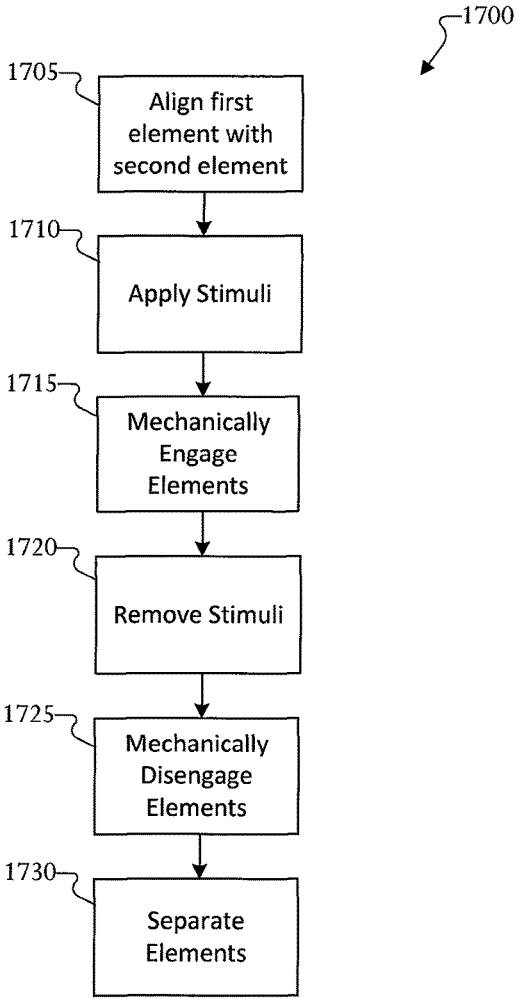
FIG. 17 illustrates a process for engaging active interlocking fastener (AIF) according to embodiments of the present disclosure.

FIG. 17 illustrates a process for engaging active interlocking fastener (AIF) according to embodiments of the present disclosure. While the flowchart 1700 depicts a series of sequential steps, unless explicitly stated, no inference should be drawn from that sequence regarding specific order of performance of steps, or portions thereof, serially rather than concurrently or in an overlapping manner, or performance the steps depicted exclusively without the occurrence of intervening or intermediate steps. The process depicted in the example is implemented with an AIF.

In block 1705, a first AIF element is aligned and brought in close proximity to a second AIF element. The first AIF element is positioned to enable one or more first interlocking fasteners to mechanically engage one or more second interlocking fasteners. The interlocking fasteners can be configured similar to any one or more of the aforementioned hooks, loops, prongs, cups, islands, and so forth.

In block 1710, an external stimulus is applied. The external stimuli can include one or more of: an electrical signal; a magnetic force; a temperature signal, such as applied heat above a certain threshold temperature or applied coolness below a threshold temperature; a fluid, such as water, saline, or another liquid; a chemical; light; or sound, such as a tone at a specific amplitude or frequency, or both.

In block 1715, in response to the external stimuli, the interlocking fasteners mechanically engage. In certain embodiments, the first interlocking fasteners react to the external stimuli to mechanically engage the second interlocking fasteners. In certain embodiments, both the first and the second interlocking fasteners react to the external stimuli to mechanically engage each other.

In block 1720, the external stimulus is removed. In certain embodiments, the liquid or chemical is manually removed from a reactive material in the interlocking fasteners to return the interlocking fasteners to its neutral state. In certain embodiments, as the liquid or chemical evaporates or changes in chemical makeup respectively, the interlocking fasteners return to their neutral state.

In block 1725, in response to removal of the external stimuli, the interlocking fasteners mechanically dis-engage. In certain embodiments, the first interlocking fasteners react to removal of the external stimuli to mechanically dis-engage from the second interlocking fasteners. In certain embodiments, both the first and the second interlocking fasteners react to the removal of the external stimuli to mechanically dis-engage from each other.

In block 1730, the first AIF element is separated from the second AIF element. The first AIF element drawn away such that a physical gap is between the fasteners and one or more first interlocking fasteners are physically too far to mechanically engage the second interlocking fasteners.

Figure 18:
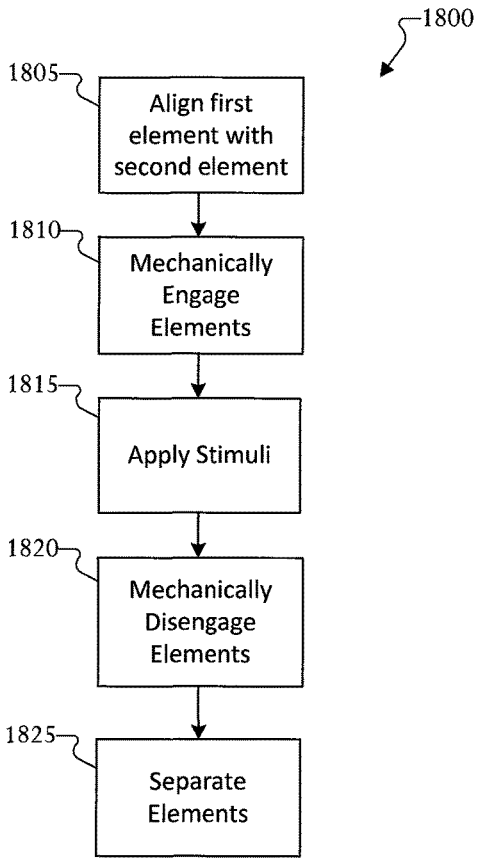
FIG. 18 illustrates a process for dis-engaging active interlocking fastener (AIF) according to embodiments of the present disclosure.

FIG. 18 illustrates a process for dis-engaging active interlocking fastener (AIF) according to embodiments of the present disclosure. While the flowchart 1600 depicts a series of sequential steps, unless explicitly stated, no inference should be drawn from that sequence regarding specific order of performance of steps, or portions thereof, serially rather than concurrently or in an overlapping manner, or performance the steps depicted exclusively without the occurrence of intervening or intermediate steps. The process depicted in the example is implemented with an AIF.

In block 1805, a first AIF element is aligned and brought in close proximity to a second AIF element. The first AIF element is positioned to enable one or more first interlocking fasteners to mechanically engage one or more second interlocking fasteners. The interlocking fasteners can be configured similar to any one or more of the aforementioned hooks, loops, prongs, cups, islands, and so forth.

In block 1810, the interlocking fasteners mechanically engage. In certain embodiments, the first interlocking fasteners are configured to be able to mechanically engage the second interlocking fasteners while in the neutral state, namely in the absence of the external stimuli. In certain embodiments, both the first and the second interlocking fasteners are configured to be able to mechanically engage each other while in the neutral state, namely in the absence of the external stimuli. That is, the interlocking fasteners can be in a locking shape or locking state in the absence of the external stimuli. In certain embodiments, the external stimuli is applied prior to the fasteners mechanically engaging and removed to cause the fasteners to mechanically engage.

In block 1815, an external stimulus is applied. The external stimuli can include one or more of: an electrical signal; a magnetic force; a temperature signal, such as applied heat above a certain threshold temperature or applied coolness below a threshold temperature; a fluid, such as water, saline, or another liquid; a chemical; light; or sound, such as a tone at a specific amplitude or frequency, or both.

In block 1820, in response to the external stimuli being added or applied, the interlocking fasteners mechanically dis-engage. In certain embodiments, the first interlocking fasteners react to addition of the external stimuli to mechanically dis-engage from the second interlocking fasteners. In certain embodiments, both the first and the second interlocking fasteners react to the addition of the external stimuli to mechanically dis-engage from each other.

In block 1825, the first AIF element is separated from the second AIF element. The first AIF element drawn away such that a physical gap is between the fasteners and one or more first interlocking fasteners are physically too far to mechanically engage the second interlocking fasteners.

Although various features have been shown in the figures and described above, various changes includes be made to the figures. For example, the size, shape, arrangement, and layout of components shown in FIGS. 1 through 16 are for illustration only. Each component could have any suitable size, shape, and dimensions, and multiple components could have any suitable arrangement and layout. Also, various components in FIGS. 1 through 16 could be combined, further subdivided, or omitted and additional components could be added according to particular needs. Further, each component in a device or system could be implemented using any suitable structure(s) for performing the described function(s). In addition, while FIGS. 17 and 18 illustrate various series of steps, various steps in FIGS. 17 and 18 could overlap, occur in parallel, occur multiple times, or occur in a different order. The embodiments described herein are provided for illustration and explanation. One or more features from any of the described embodiments can be incorporated into other embodiments without departing from the scope of the disclosure.

What is claimed is:

1. An interlocking fastener system comprising:

a first element including a plurality of first interlocking fasteners and a carrier structure configured to communicate a stimulus signal to the plurality of first interlocking fasteners: and a second element including a plurality of second interlocking fasteners configured to couple to and decouple from the plurality of first interlocking fasteners, wherein the plurality of first interlocking fasteners comprises a reactive material configured to alter a shape or orientation of the first interlocking fasteners between; a mechanical dis-engagement shape or orientation when the stimulus signal is being communicated to the reactive material via the carrier structure and a mechanical engagement shape or orientation when the stimulus signal is not being communicated to the reactive material via the carrier structure; and wherein the carrier structure of the first element comprises an activation structure that includes a tube configured to communicate the stimulus signal to the reactive material of each one of the plurality of first interlocking fasteners.

2. The interlocking fastener system of claim 1, wherein the reactive material comprises at least one of: electroactive polymers (EAP), stimuli-responsive gels, shape memory alloys (SMA), polyacrylonitrile artificial muscles, artificial cilia, an electrorheological liquid or a phase changing chemical.

3. The interlocking fastener system of claim 1, wherein, in response to the stimulus signal being communicated to the reactive material, the reactive material is configured to cause the plurality of first interlocking fasteners to alter in shape or orientation to mechanically dis-engage from the plurality of second interlocking fasteners.

4. The interlocking fastener system of claim 3, wherein, when mechanically engaged, the plurality of first interlocking fasteners and the plurality of second interlocking fasteners form at least one of an air-tight seal, water-tight seal or weather seal.

5. The interlocking fastener system of claim 1, wherein at least one of the plurality of first interlocking fasteners or the plurality of second interlocking fasteners comprises:

hooks,
loops,
self-engaging prongs,
constricting cups,
self-engaging islands, or
edge fasteners.

6. The interlocking fastener system of claim 1, wherein the plurality of first interlocking fasteners are configured to deform, bend, twist, elongate, straighten, slim, expand, bend, constrict, open or close when the reactive material alters to the mechanical dis-engagement shape or orientation while the stimulus signal is communicated via the carrier structure.

7. The interlocking fastener system of claim 1, wherein the stimulus signal communicated via the carrier structure comprises at least one of: an electrical signal; a temperature signal; a fluid; a chemical; light; sound, a tone at a specific amplitude, or a tone at a specific frequency.

8. An interlocking apparatus comprising:

a plurality of first interlocking fasteners configured to couple to a plurality of second interlocking fasteners and a transmission conduit connected to the plurality of first interlocking fasteners to apply a stimulus signal to the plurality of first interlocking fasteners, the plurality of first interlocking fasteners comprises a reactive material configured to vary a shape or orientation of the plurality of first interlocking fasteners from a first shape or orientation to a second shape or orientation when the stimulus signal is applied from the transmission conduit, wherein the first shape or orientation is a mechanical dis-engagement shape or orientation and the second shape or orientation is a mechanical engagement shape or orientation with respect to the plurality of second interlocking fasteners, or wherein the first shape or orientation is a mechanical engagement shape or orientation and the second shape or orientation is a mechanical dis-engagement shape or orientation with respect to the plurality of second interlocking fasteners;

wherein the transmission conduit comprises an activation structure that includes a tube connected to the plurality of first interlocking fasteners; and wherein the stimulus signal comprises at least one of an electric signal a temperature signal a fluid, or a chemical.

9. The interlocking apparatus of claim 8, wherein the reactive material comprises at least one of: electroactive polymers (EAP), stimuli-responsive gels, shape memory alloys (SMA), polyacrylonitrile artificial muscles, artificial cilia, an electrorheological liquid or a phase changing chemical.

10. The interlocking apparatus of claim 8, wherein, in response to application of the stimulus signal to the reactive material via the transmission conduit, the reactive material is configured to cause the plurality of first interlocking fasteners to mechanically engage the plurality of second interlocking fasteners; or in response to application of the stimulus signal to the reactive material via the transmission conduit, the reactive material is configured to cause the plurality of first interlocking fasteners to mechanically dis-engage from the plurality of second interlocking fasteners.

11. The interlocking apparatus of claim 10, wherein, when engaged, the plurality of first interlocking fasteners and the plurality of second interlocking fasteners form at least one of an air-tight seal, water-tight seal or weather seal.

12. The interlocking apparatus of claim 8, wherein the plurality of first interlocking fasteners comprises:

hooks, loops, self-engaging prongs, constricting cups, self-engaging islands, or edge fasteners.

13. The interlocking apparatus of claim 8, wherein the plurality of first interlocking fasteners is configured to deform, bend, twist, elongate, straighten, slim, expand, bend, constrict, open or close when the reactive material varies the shape or orientation of the plurality of first interlocking fasteners when the stimulus signal is applied via the transmission conduit.

* * * * *